US009701004B2

(12) United States Patent
Hardinge et al.

(10) Patent No.: US 9,701,004 B2
(45) Date of Patent: Jul. 11, 2017

(54) MULTI-PURPOSE TOOL HAVING REMOVABLE HANDLE FOR USE AS A HAND TOOL

(71) Applicant: Fiskars Brands, Inc., Madison, WI (US)

(72) Inventors: Hal Hardinge, Tigard, OR (US); John Nason, Keizer, OR (US); Darrin Seeds, Vancouver, WA (US)

(73) Assignee: Fiskars Brands, Inc., Middleton, WI (US)

( * ) Notice: Subject to any disclaimer, the term of this patent is extended or adjusted under 35 U.S.C. 154(b) by 175 days.

(21) Appl. No.: 13/659,717

(22) Filed: Oct. 24, 2012

(65) Prior Publication Data

US 2013/0097786 A1 Apr. 25, 2013

Related U.S. Application Data

(60) Provisional application No. 61/551,337, filed on Oct. 25, 2011.

(51) Int. Cl.

| | |
|---|---|
| ***B25F 1/02*** | (2006.01) |
| ***B25F 1/04*** | (2006.01) |
| ***B26B 1/08*** | (2006.01) |
| ***B25F 1/00*** | (2006.01) |
| ***B25G 1/08*** | (2006.01) |
| ***B25G 3/18*** | (2006.01) |

(52) U.S. Cl.

CPC ..... *B25F 1/04* (2013.01); *B25F 1/003* (2013.01); *B25G 1/085* (2013.01); *B25G 3/18* (2013.01)

(58) Field of Classification Search

CPC .... B25F 1/003; B25F 1/02; B25F 1/04; B25B 7/22; B25G 1/04; B25G 1/08; B25G 1/085; B25G 3/18

USPC ..... 7/128, 129, 167, 168, 165

See application file for complete search history.

(56) References Cited

U.S. PATENT DOCUMENTS

| | | | | |
|---|---|---|---|---|
| 844,130 | A * | 2/1907 | Howard | B23B 31/113 15/145 |
| 986,761 | A * | 3/1911 | Roscoe | B23B 31/103 15/145 |
| 2,478,696 | A | 8/1949 | Isele | |

(Continued)

FOREIGN PATENT DOCUMENTS

| | | |
|---|---|---|
| EP | 0 931 628 | 7/1999 |
| EP | 0 653 975 B1 | 10/2001 |

(Continued)

OTHER PUBLICATIONS

International Search Report and Written Opinion for PCT/US2012/061714, mail date Dec. 17, 2013, 14 pages.

(Continued)

*Primary Examiner* — Hadi Shakeri

(74) *Attorney, Agent, or Firm* — Foley & Lardner LLP

(57) ABSTRACT

A multi-purpose tool includes a jaw head, a first handle removably coupled to the jaw head and a second handle coupled to the jaw head. The first handle includes a body and a hand tool pivotably coupled to the body. The hand tool is moveable between a closed position in which the hand tool is disposed within the body and an open position in which the hand tool extends out of the body. The first handle can be removed from the jaw head to be utilized separately from the jaw head.

20 Claims, 17 Drawing Sheets

(56) References Cited

U.S. PATENT DOCUMENTS

| | | | | |
|---|---|---|---|---|
| 4,238,862 | A | 12/1980 | Leatherman | |
| D270,613 | S | 9/1983 | Morgan | |
| 4,735,117 | A | 4/1988 | Ducret | |
| 4,744,272 | A | 5/1988 | Leatherman | |
| 4,967,435 | A | 11/1990 | Seals | |
| 4,995,128 | A * | 2/1991 | Montgomery | B25B 7/02 7/127 |
| D327,826 | S | 7/1992 | Neff | |
| 5,142,721 | A | 9/1992 | Sessions et al. | |
| 5,212,844 | A | 5/1993 | Sessions et al. | |
| 5,280,659 | A | 1/1994 | Park | |
| 5,303,439 | A | 4/1994 | Seals | |
| 5,357,643 | A | 10/1994 | Seals | |
| D367,807 | S | 3/1996 | Hung | |
| 5,564,318 | A | 10/1996 | Pail | |
| RE35,424 | E | 1/1997 | Seals | |
| 5,664,274 | A * | 9/1997 | Collins | 7/129 |
| 5,697,114 | A | 12/1997 | McIntosh et al. | |
| D389,030 | S | 1/1998 | Wensley | |
| 5,781,950 | A | 7/1998 | Swinden et al. | |
| D400,071 | S | 10/1998 | Wang | |
| 5,916,277 | A | 6/1999 | Dallas | |
| 5,963,999 | A | 10/1999 | Gardiner et al. | |
| 6,003,180 | A | 12/1999 | Frazer | |
| 6,006,385 | A | 12/1999 | Kershaw et al. | |
| 6,009,582 | A | 1/2000 | Harrison et al. | |
| 6,023,805 | A | 2/2000 | Lin | |
| 6,038,723 | A | 3/2000 | Nabors et al. | |
| D424,899 | S | 5/2000 | Jaime | |
| 6,088,860 | A | 7/2000 | Poehlmann et al. | |
| D428,785 | S | 8/2000 | Jimenez et al. | |
| 6,108,845 | A * | 8/2000 | Hung | B25F 1/003 30/260 |
| 6,131,495 | A | 10/2000 | Chen | |
| D433,608 | S | 11/2000 | Poehlmann et al. | |
| 6,145,144 | A | 11/2000 | Poehlmann et al. | |
| 6,185,771 | B1 | 2/2001 | Trusty, Sr. | |
| 6,219,870 | B1 | 4/2001 | Swinden et al. | |
| 6,223,374 | B1 | 5/2001 | Lin | |
| D445,326 | S | 7/2001 | Alfaro | |
| 6,276,063 | B1 | 8/2001 | Chen | |
| 6,282,996 | B1 | 9/2001 | Berg et al. | |
| 6,305,041 | B1 | 10/2001 | Montague et al. | |
| 6,341,423 | B1 | 1/2002 | Taggart et al. | |
| D454,044 | S | 3/2002 | Alfaro | |
| 6,405,395 | B1 | 6/2002 | Poehlmann et al. | |
| D467,783 | S | 12/2002 | Onion | |
| 6,487,941 | B1 | 12/2002 | Ping | |
| 6,523,203 | B2 | 2/2003 | Harrison | |
| D472,433 | S | 4/2003 | Richwine et al. | |
| 6,594,906 | B1 | 7/2003 | Sakai et al. | |
| 6,618,885 | B1 | 9/2003 | Blaustein | |
| 6,622,328 | B2 | 9/2003 | Rivera | |
| 6,625,832 | B2 | 9/2003 | Montague et al. | |
| D480,940 | S | 10/2003 | Dallas | |
| D480,941 | S | 10/2003 | Dallas | |
| D481,289 | S | 10/2003 | Dallas | |
| 6,640,675 | B1 * | 11/2003 | Chuang | 7/167 |
| 6,643,877 | B1 | 11/2003 | Amtenbrink et al. | |
| D486,716 | S | 2/2004 | Levine et al. | |
| 6,691,357 | B2 | 2/2004 | Rivera | |
| D488,700 | S | 4/2004 | Montague | |
| 6,721,983 | B2 * | 4/2004 | Dallas et al. | 7/128 |
| 6,721,984 | B1 | 4/2004 | Harrison | |
| D493,685 | S | 8/2004 | Dallas | |
| D505,057 | S | 5/2005 | Ralph | |
| D515,903 | S | 2/2006 | Kelleghan | |
| 7,000,323 | B1 | 2/2006 | Hatcher et al. | |
| 7,028,591 | B2 | 4/2006 | Dallas et al. | |
| 7,039,974 | B2 | 5/2006 | Berg | |
| 7,063,435 | B2 | 6/2006 | Dallas et al. | |
| D532,662 | S | 11/2006 | Chang | |
| D532,672 | S | 11/2006 | Steiner | |
| 7,150,210 | B2 | 12/2006 | Berg et al. | |
| D535,171 | S | 1/2007 | Ping | |
| D553,467 | S | 10/2007 | Ryan | |
| D557,100 | S | 12/2007 | Stokes et al. | |
| 7,334,502 | B1 | 2/2008 | Durkee | |
| 7,347,128 | B2 | 3/2008 | Rivera et al. | |
| 7,363,669 | B2 | 4/2008 | Berg et al. | |
| D568,710 | S | 5/2008 | Klecker et al. | |
| D571,181 | S | 6/2008 | Klecker et al. | |
| D573,437 | S | 7/2008 | Nenadic | |
| D573,865 | S | 7/2008 | Klecker et al. | |
| D592,931 | S | 5/2009 | Nenadic | |
| D597,811 | S | 8/2009 | Yu | |
| D600,527 | S | 9/2009 | Nyssen et al. | |
| D600,528 | S | 9/2009 | Nyssen et al. | |
| D623,039 | S | 9/2010 | Seeds et al. | |
| D623,040 | S | 9/2010 | Freeman et al. | |
| D628,036 | S | 11/2010 | Steiner | |
| D630,079 | S | 1/2011 | Seeds et al. | |
| 7,908,944 | B2 | 3/2011 | Nason et al. | |
| 7,909,478 | B2 | 3/2011 | Dallas | |
| D639,627 | S | 6/2011 | Seeds et al. | |
| 7,997,170 | B1 * | 8/2011 | Martinez et al. | 7/128 |
| D660,125 | S | 5/2012 | Seeds et al. | |
| D660,126 | S | 5/2012 | Cagampang et al. | |
| D660,678 | S | 5/2012 | Thomas et al. | |
| 8,316,549 | B2 * | 11/2012 | Musser | 7/129 |
| 8,429,948 | B1 | 4/2013 | Warren | |
| 2002/0046425 | A1 | 4/2002 | Dallas et al. | |
| 2002/0124322 | A1 | 9/2002 | Montague | |
| 2004/0003472 | A1 | 1/2004 | Dallas et al. | |
| 2006/0107800 | A1 | 5/2006 | Dallas et al. | |
| 2009/0090225 | A1 | 4/2009 | Nenadic | |
| 2011/0145998 | A1 | 6/2011 | Caniparoli et al. | |
| 2012/0151681 | A1 | 6/2012 | Purnomohadi et al. | |
| 2012/0227187 | A1 | 9/2012 | Caniparoli et al. | |
| 2013/0180054 | A1 | 7/2013 | Huttula et al. | |

FOREIGN PATENT DOCUMENTS

| | | |
|---|---|---|
| EP | 1 163 981 | 12/2001 |
| WO | WO-2013/063132 | 5/2013 |

OTHER PUBLICATIONS

U.S. Appl. No. 29/335,234, filed Apr. 10, 2009, Freeman et al.
U.S. Appl. No. 29/433,135, filed Sep. 26, 2012, Seeds et al.
U.S. Appl. No. 29/435,902, filed Oct. 30, 2012, Cagampang et al.
Freestyle™ CX, printed from website www.leatherman.com, available at least as early as Aug. 6, 2009, 1 page.
Gerber MP700, printed from website www.swords24, available at least as early as Aug. 6, 2009, 1 page.
Gerber MP800, printed from website www.gerbergear.com, available at least as early as Aug. 6, 2009, 1 page.
Invitation to Pay Additional Fees and Partial Search Report for Application PCT/US2012/061714, mail date Apr. 12, 2013, 4 pages.
Leatherman Wave®, printed from website www.leatherman.com, available at least as early as Aug. 6, 2009, 1 page.
Skeletool® CX, printed from website www.leatherman.com, available at least as early as Aug. 6, 2009, 1 page.
SL™ Plier, Toollogic, Built for Life, printed from website www.toollogic.com, avaiable at least as early as Aug. 6, 2009, 1 page.
English-language translation of Chinese Office Action, CN 201280052819.2, Fiskars Brands, Inc., 7 pages (Dec. 1, 2015).

* cited by examiner

MULTI-PURPOSE TOOL HAVING REMOVABLE HANDLE FOR USE AS A HAND TOOL

CROSS-REFERENCE TO RELATED PATENT APPLICATIONS

This application claims the benefit of U.S. Provisional Patent Application No. 61/551,337, filed Oct. 25, 2011, which is incorporated herein by reference in its entirety.

BACKGROUND

The present invention relates to a multi-purpose tool. In particular, the present invention relates to a multi-purpose tool having at least one removable handle for use as a hand tool separate from the multi-purpose tool.

Current users of communication and electrician tools are required to carry multiple different tools in order to perform their jobs. For example, a communication professional may need a cable crimper/wire stripper-based tool as well as multiple different sizes of screwdrivers and a knife. As another example, an electrician may need a wire stripper/cutter-based tool as well as multiple different sizes of screwdrivers, a utility blade, and a sheet rock saw.

The jaws on traditional pliers-based multi-function devices that store components in the handles are generally not large enough to strip or crimp wires properly. If the pliers are large enough to complete the wire stripper/crimping task, then the tools in the handles are unusable because the components are either too small, or the large handles make the tools difficult to use.

SUMMARY

One embodiment of the invention relates to a multi-purpose tool including a jaw head, a first handle removably coupled to the jaw head, and a second handle coupled to the jaw head. The first handle includes a body and a hand tool pivotably coupled to the body. The hand tool is moveable between a closed position in which the hand tool is disposed within the body and an open position in which the hand tool extends out of the body. The first handle can be removed from the jaw head to be utilized separately from the jaw head.

Another embodiment of the invention relates to a multi-purpose tool including a jaw head with a pair of jaws pivotably coupled together. Each of the jaws includes a tang. The multi-purpose tool further includes a locking mechanism coupled to the jaw head and a handle coupled to the tang. The locking mechanism is movable between a locked position and an unlocked position. The handle is fixed to the jaw head when the locking mechanism is in the locked position and the handle is able to be removed from the tang when the locking mechanism is in the unlocked position.

Another embodiment of the invention relates to a utility knife including an outer casing, an inner frame member housed within the outer casing, a blade with a notch, and a blade carrier with a notch and configured to receive the blade. The blade carrier is slidably coupled to the inner frame and moveable between a first position in which the blade is disposed within the outer casing and a second position in which the blade extends outside of the outer casing. The utility knife further includes a slide button coupled to the blade carrier and extending outside of the outer casing, a latch arm with a tab disposed within the outer casing, and a cam plate coupled to the inner frame and disposed within the outer casing. The tab is configured to be received in the notches in the blade and the blade carrier to couple the blade to the blade carrier when the blade carrier is in the first position or the second position. The blade carrier is further moveable beyond the second position to a third position. Contact between the cam plate and the latch arm as the blade carrier moves beyond the second position forces the tab out of the notches and decouples the blade from the blade carrier in the third position.

DETAILED DESCRIPTION

Figure 1:
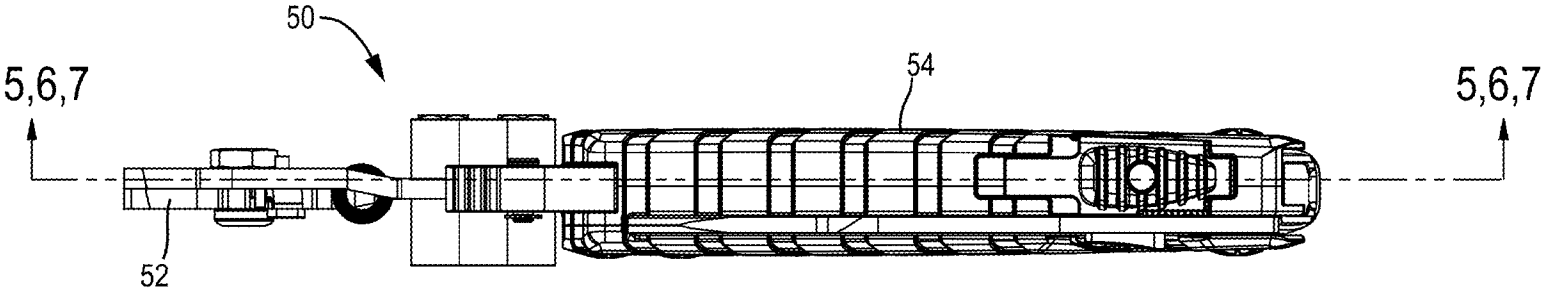
FIG. 1 is a top view of a multi-purpose tool, in accordance with an exemplary embodiment.
Figure 2:
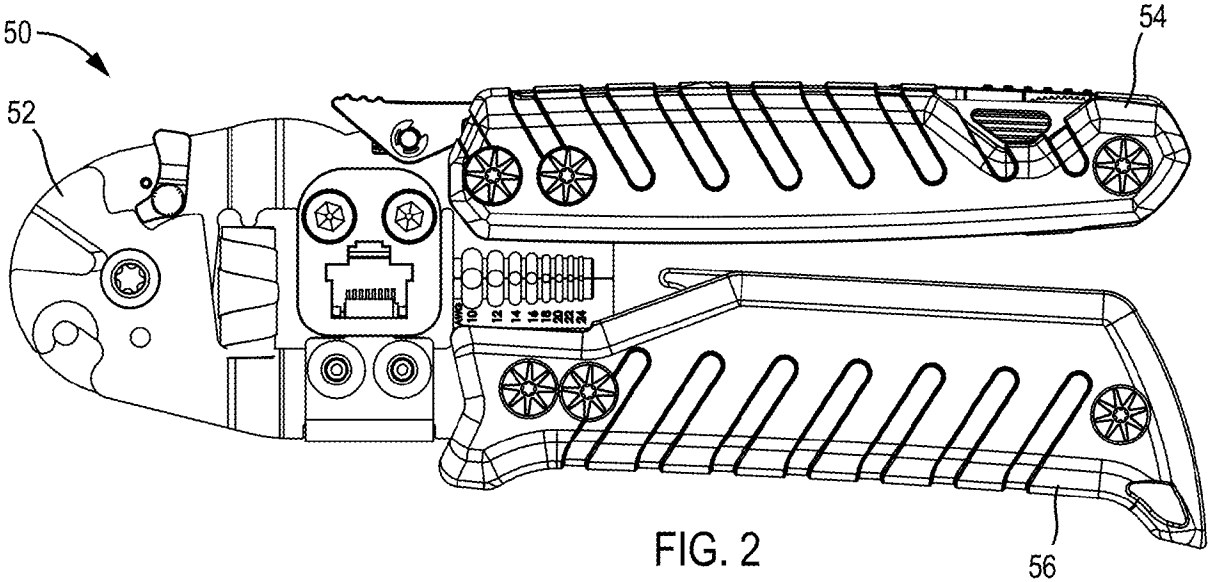
FIG. 2 is a front view of the multi-purpose tool of FIG. 1.

According to an exemplary embodiment, a multi-purpose tool (e.g., a communications tool, an electrician's tool, etc.) is shown in the FIGS. 1-25. The multi-purpose tool includes a jaw head and at least one removable handle that can be removed from the multi-purpose tool and used separately from the multi-purpose tool. For example, the multi-purpose tool is shown as a communications tool 50 in FIGS. 1-11B, and as an electrician's tool 250 in FIGS. 12-25.

The multi-purpose tool, as shown in FIGS. 1-25, allows a user to have a full-sized multi-purpose tool (e.g., a cable or wire crimper/stripper/cutter) while also providing a useable set of hand tools that are conveniently stored in one or both of the handles. To accomplish this, a handle is detached or removed from a head of the multi-purpose tool and used as a stand-alone tool. For example, the multi-purpose tool has utility or functionality as a full-sized tool (e.g., a cable or wire crimper/stripper/cutter) and a removable handle (or handles) has separate utility or functionality as stand-alone hand tools (e.g., screw driver, bit driver, utility blade, knife, saw, etc.). The removable handle may also store components of the stand-alone tool (e.g., bits). By having at least one removable handle, the multi-purpose tool provides the benefit of a full-sized crimper/stripper/cutter, but also provides the benefit of having a full-sized set of hand tools without the overall multi-purpose tool being too large or clunky, and the user having to have separate tools.

Referring now to FIGS. 1-11, a multi-purpose tool having at least one removable handle 54 is shown as a communications tool 50. The communications tool 50 includes various tools or features useful to a communication professional (e.g., a cable lineman or field serviceman). The communications tool 50 includes various tools and features for crimping/stripping/cutting cables, wires, or other materials. The communications tool 50 also includes various hand tools such as a bit driver configured to use multiple bits (e.g., Phillips, flat, cable punch downs, etc.), a small flat screwdriver, a serrated knife with safety hook cutter, etc.

According to an exemplary embodiment, the crimper/stripper/cutter features of the communications tool 50 are provided by the head or jaw (e.g., jaw head 52) of the multi-purpose tool while all the various hand tools are provided in either the removable handle 54 or the fixed handle 56 of the communications tool 50. For example, the removable handle 54 includes the bit driver 58, the small flat driver 60 and a knife 62 (see FIG. 9); while the fixed handle 56 provides storage for the various bits 64 (see FIG. 11B). According to another exemplary embodiment, the fixed handle 56 may be configured to be removable from the jaw head 52 of the communications tool 50 (similar to the removable handle 54, as described in more detail below).

Figure 3A:
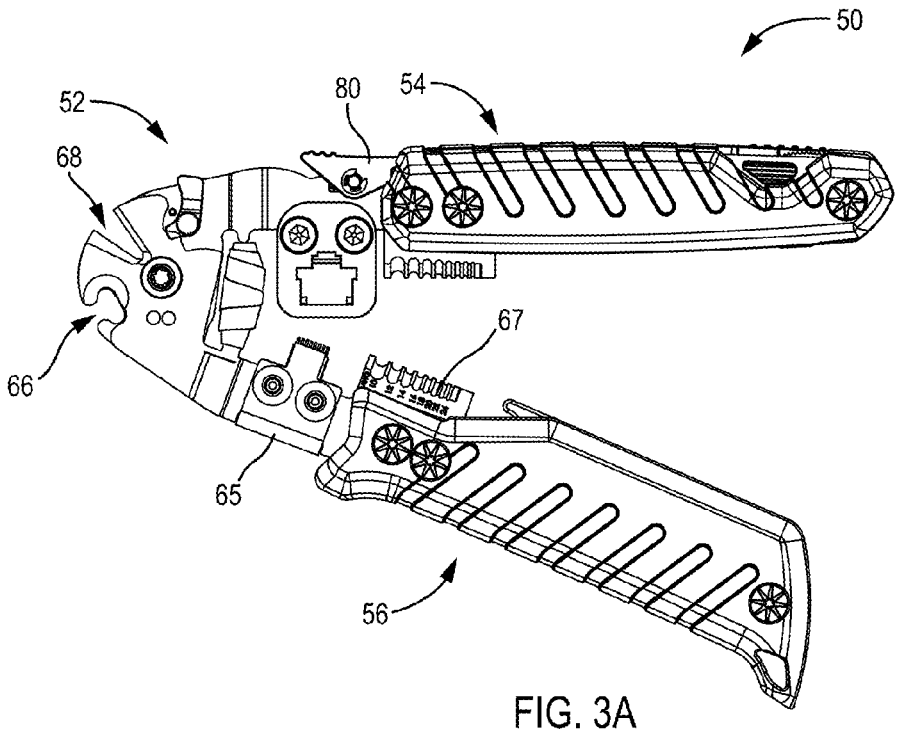
FIG. 3A is a front view of the multi-purpose tool of FIG. 1 with the removable handle coupled to the jaw head, in accordance with an exemplary embodiment.
Figure 3B:
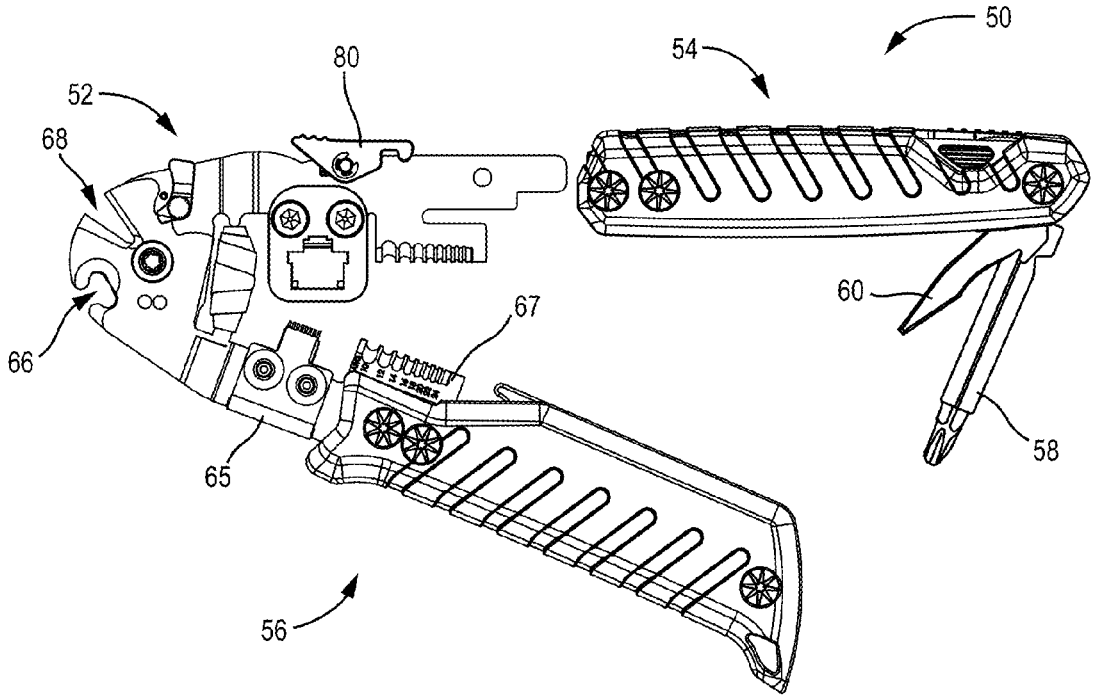
FIG. 3B is a front view of the multi-purpose tool of FIG. 1 with the removable handle decoupled from the jaw head with several tools deployed, in accordance with an exemplary embodiment.

As shown in FIGS. 3A and 3B, the jaw head 52 of the communications tool 50 includes a cable crimper, a cable stripper, a wire stripper, and a wire cutter. According to one exemplary embodiment, the cable crimper and the cable stripper are both configured for a CAT5e size cable; however, according to other exemplary embodiments, the cable crimper and cable stripper may be configured for a different sized cable. According to one exemplary embodiment, the wire stripper is configured to be able to strip wires of 24 gauge to 10 gauge; however, according to other exemplary embodiments, the wire stripper may be configured to strip other sized wires.

Figure 4:
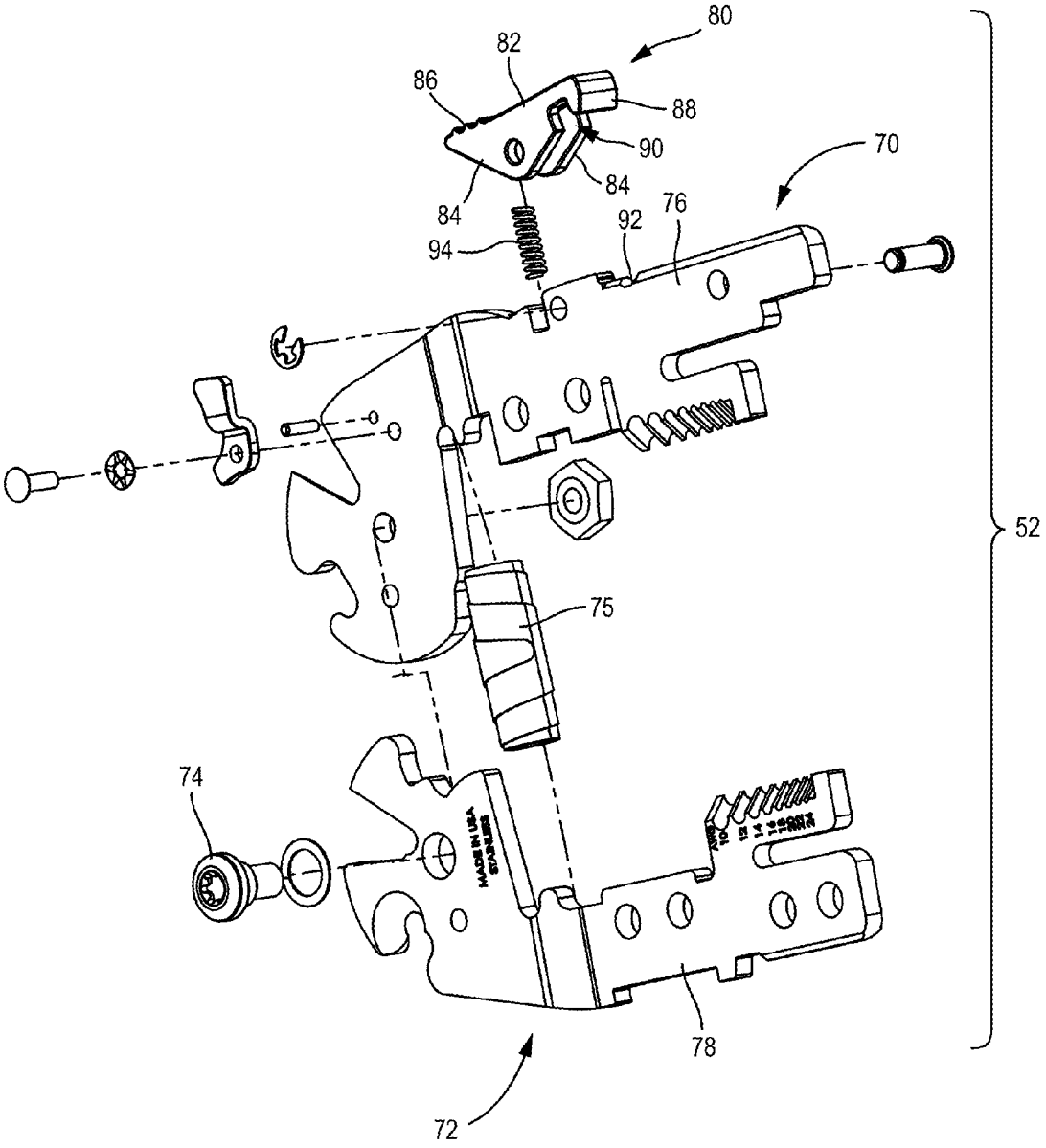
FIG. 4 is an exploded view of the jaw head of the multi-purpose tool of FIG. 1, in accordance with an exemplary embodiment.

According to an exemplary embodiment, shown best in FIG. 4, the jaw head 52 includes a first jaw portion 70 that is configured to be pivotally coupled to a second jaw portion 72 (e.g., with a bolt 74 or other fastener). The jaw head 52 includes a biasing member such as a spring shown as a barrel spring 75 that is configured biased the jaw head 52 in an open position. Tangs 76 and 78 extend rearwardly from the first jaw portion 70 and the second jaw portion 72, respectively.

According to an exemplary embodiment, the first jaw portion 70 includes a locking assembly shown to include a latch or lock lever 80 for selectively affixing the removable handle 54 to the jaw head 52. As shown best in FIG. 4, the lock lever 80 is pivotally coupled to an outer edge of the tang 76 of the first jaw portion 70 (e.g., by a fastener or other mechanism, such as a pin and e-clip assembly). The lock lever 80 includes a body portion 82 and a pair of opposing arms 84 extending from the body 82, each arm 84 including an opening for receiving a pin for coupling the lock lever 80 to the first jaw portion 70. A first end of the body 82 includes a series of ridges 86 for engagement with a finger of a user for actuating or rotating the lock lever 80 from a closed or locked position to an open or unlocked position. A tab or projection 88 extends away from the second end the body 82 at a generally right angle or a direction perpendicular to the body 82. A recess 90 is formed between the tab or projection 88 and the arm 84 and is configured to aid the tab or projection 88 in engaging a portion of the removable handle 54 (e.g., a notch 102 of an inner frame 100, see FIG. 8) to lock the removable handle 54 to the first jaw portion 70 when the removable handle 54 is in an installed position on the tang 76 and the lock lever 80 is in the locked position. According to an exemplary embodiment, the lock lever 80 is biased in a locked position via a biasing member shown as a coil spring 94.

Figure 5:
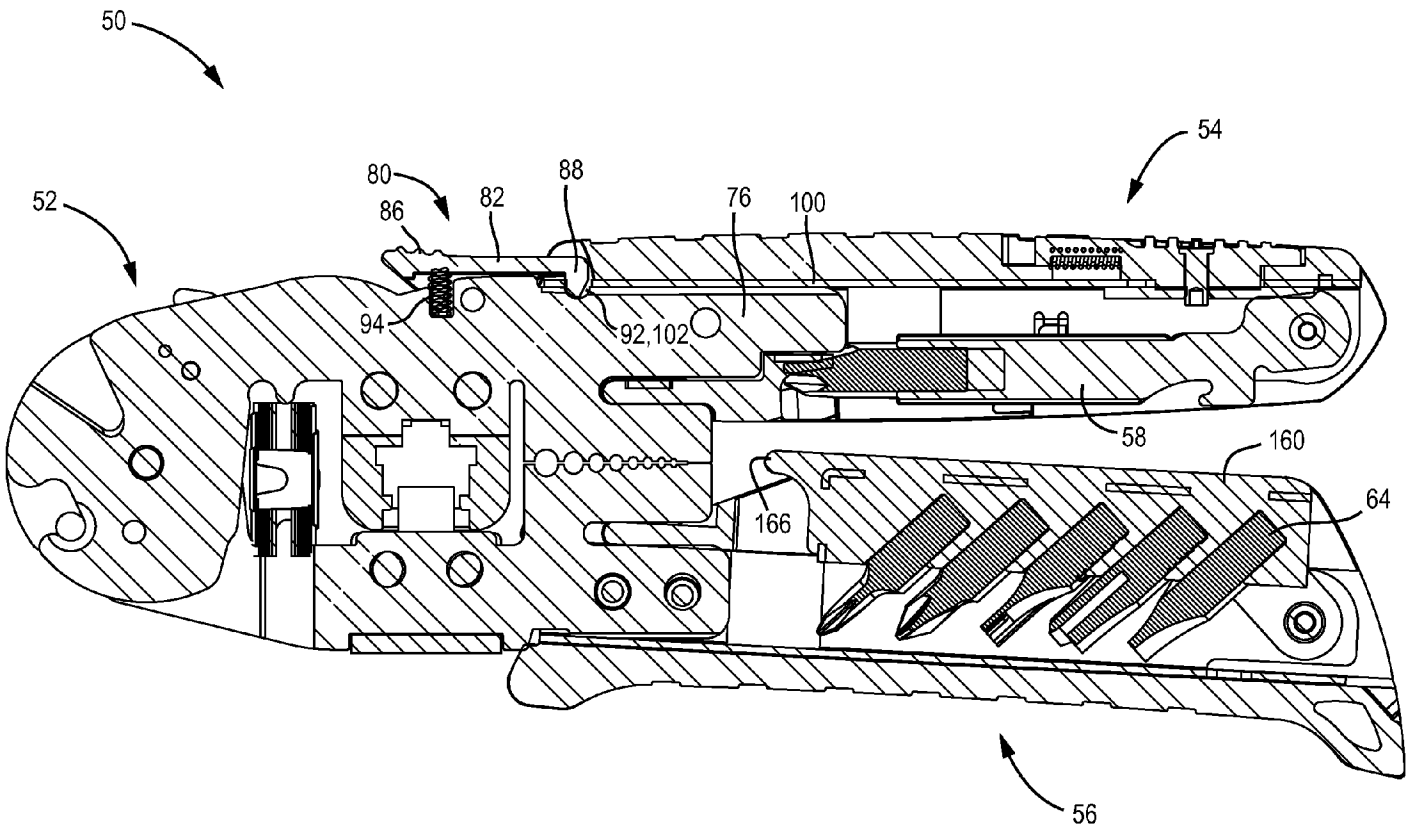
FIG. 5 is a cross-section view of the multi-purpose tool of FIG. 1, taken along line 8-8, with the removable handle locked.
Figure 6:
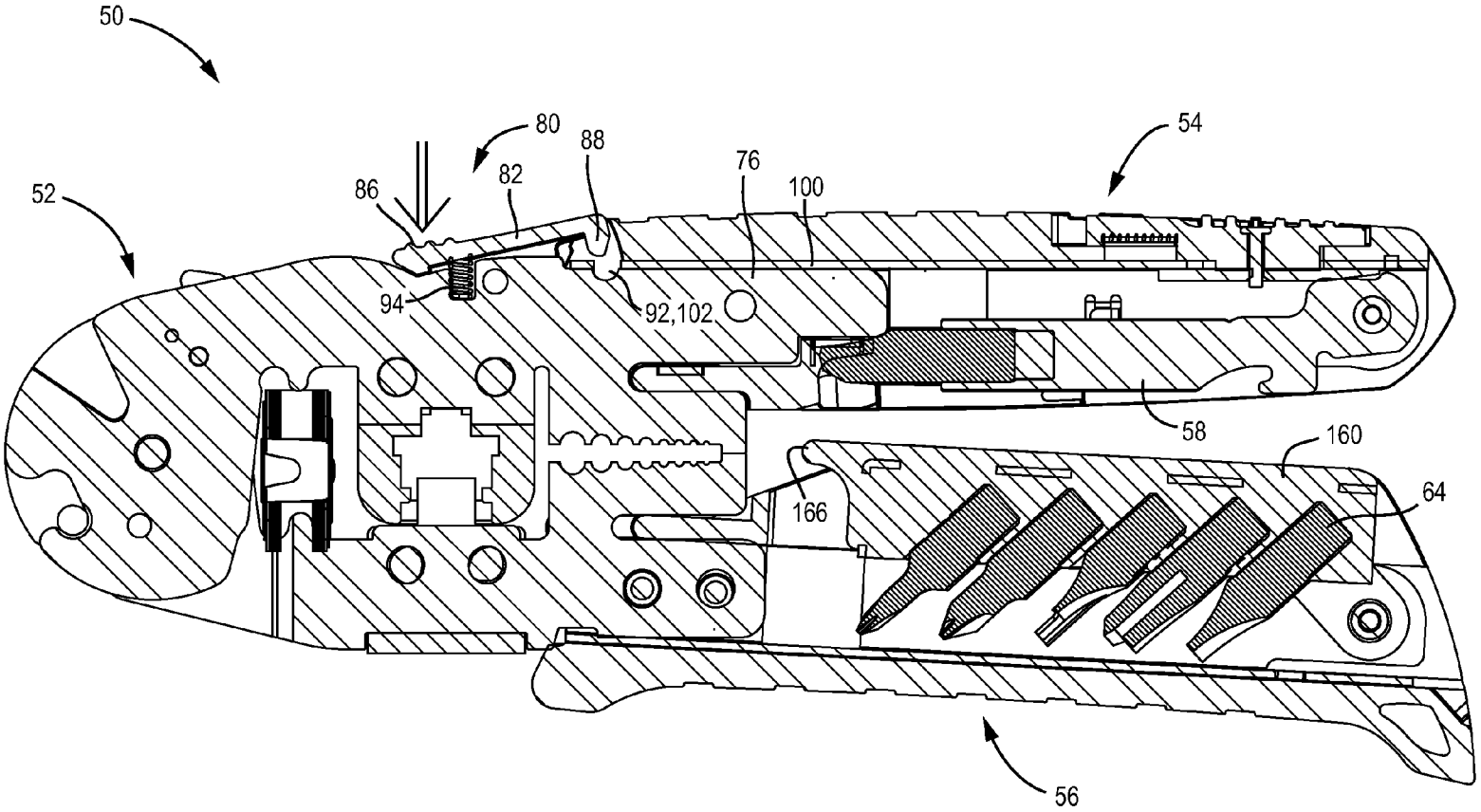
FIG. 6 is a cross-section view of the multi-purpose tool of FIG. 1, taken along line 9-9, with the removable handle unlocked.
Figure 7:
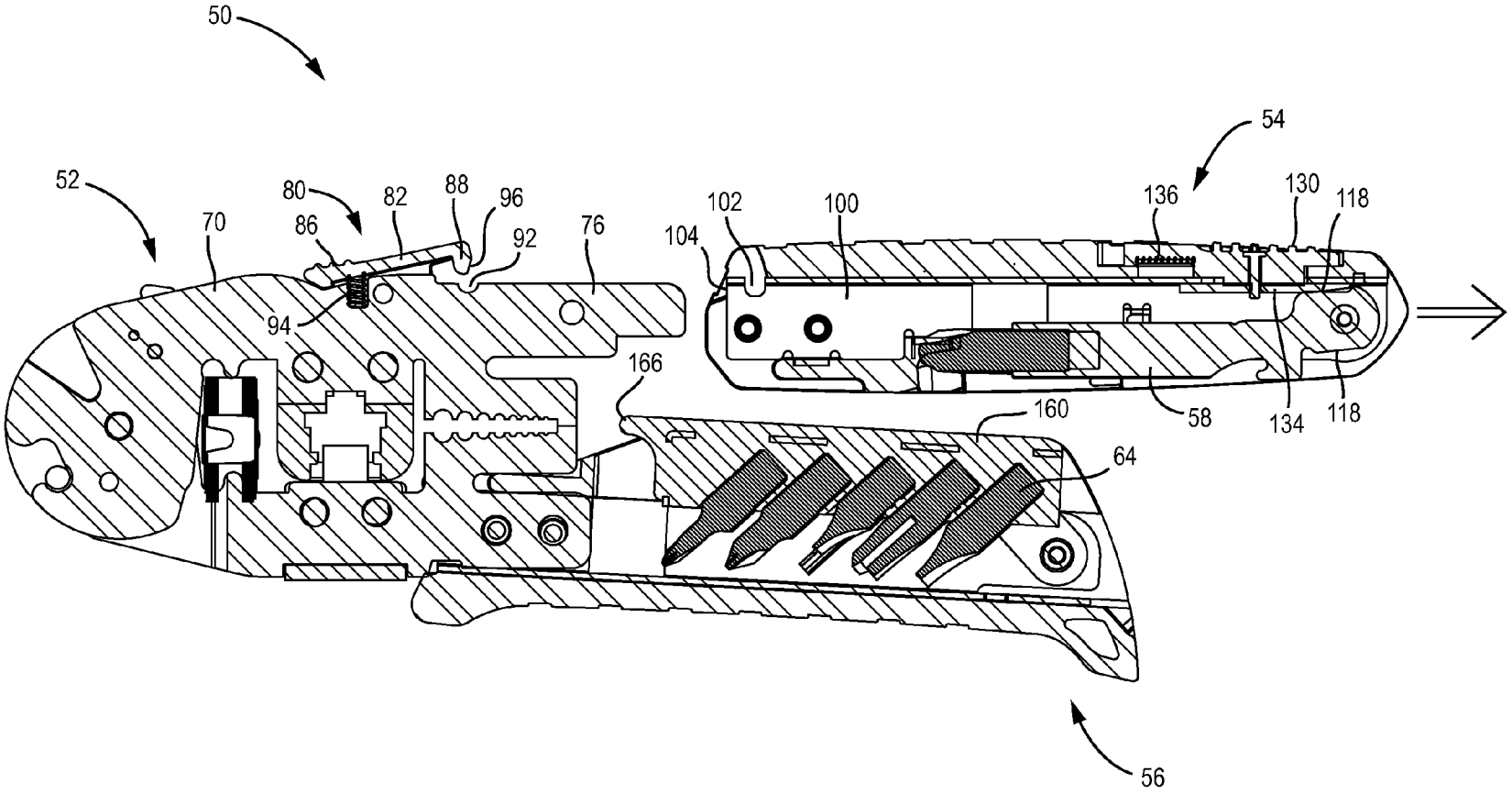
FIG. 7 is a cross-section view of the multi-purpose tool of FIG. 1, taken along line 10-10, with the removable handle removed.
Figure 8:
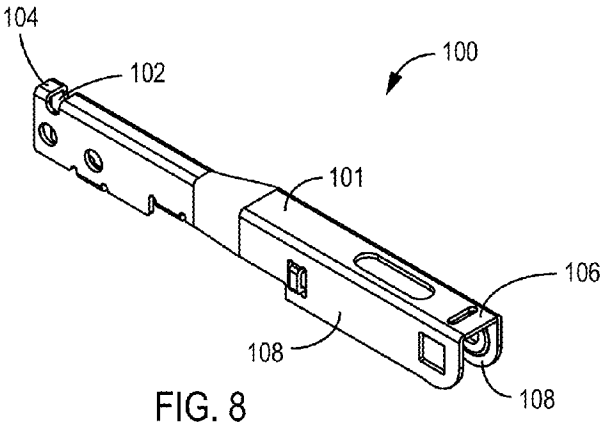
FIG. 8 is an isometric view of the inner frame of the removable handle of the multi-purpose tool of FIG. 1, in accordance with an exemplary embodiment.

To release the removable handle 54 from the communications tool 50, a user pushes down on the first end of the lock lever 80 to rotate the lock lever 80 from a locked position (as shown in FIG. 5) to the unlocked position (as shown in FIG. 6). Once the lock lever 80 is in the unlocked position, the tab or projection 88 of the lock lever 80 is cleared or disengaged from a corresponding notch or cutout 92 in the first jaw portion 70 and a notch or cutout 102 in a frame 100 of the removable handle 54 (as shown in FIG. 8). The removable handle 54 can then be removed (e.g., slid off) from the communications tool 50 (as shown in FIG. 7) and used as a separate hand tool. Once a user releases the first end of the lock lever 80 (e.g., by releasing pressure on the ridges 86), the lock lever 80 returns to its locked position (e.g., by the biasing member 94).

One advantage of the design of the lock lever 80 is that the projection 88 of the lock lever 80 engages both the notch 102 in the frame 100 of the removable handle 54 and also a notch 92 in the first jaw portion 70 of the jaw head 52. By engaging both the notches 102 and 92 of the frame 100 and first jaw portion 70, respectively, the lock lever 80 rigidly secures the removable handle 54 to the first jaw portion 70 so that the removable handle 54 does not move or slide around with the jaw portion 70 when using the communications tool 50 (i.e., when the removable handle 54 is engaged with the first jaw portion 70).

To reattach the removable handle 54 to the communications tool 50, a user simply slides the removable handle 54 onto the tang 76 of the first jaw portion 70. As the removable handle 54 is slid onto the tang 76, a first end or edge 104 of the frame comes in contact with an angled surface 96 of the projection 88 of the lock lever 80, causing the lock lever 80 to rotate to the open position. As the removable handle 54 is slid slightly farther into position, the projection 88 of the lock lever 80 then engages with the notch 102 in the frame 100 and the notch 92 in the first jaw portion 70, locking the removable handle 54 into place. Thus, as a user slides the removable handle 54 onto the tang 76 of the first jaw portion 70, the removable handle 54 is automatically locked into place.

As shown in FIG. 8, the frame 100 includes a body member 101 and a pair of opposing arms projecting 108 out from the body member 101. According to an exemplary embodiment, the first end 104 of the body member 101 is more narrow than a second end 106 of the body member 101. As described above, the notch or cutout that is configured to engage with the projection of the lock lever of the jaw is formed in the first end 104 of the body member 101. The frame is configured to be inserted into a cover to form the removable handle 54 (e.g., as shown in FIG. 9).

The narrow first end 104 of the frame 100 is configured to surround the tang 76 of the first jaw portion 70. According to an exemplary embodiment, the arms 108 of the narrow first end 104 of the frame 100 are spaced apart a distance corresponding to a width of the tang 76 such that the removable handle 54 fits tightly (e.g., closely, securely, snuggly, etc.) with the first jaw portion 70. According to an exemplary embodiment, the pair of arms 108 of the frame 100 form a substantially closed channel into which the tang 76 is inserted.

Figure 9:
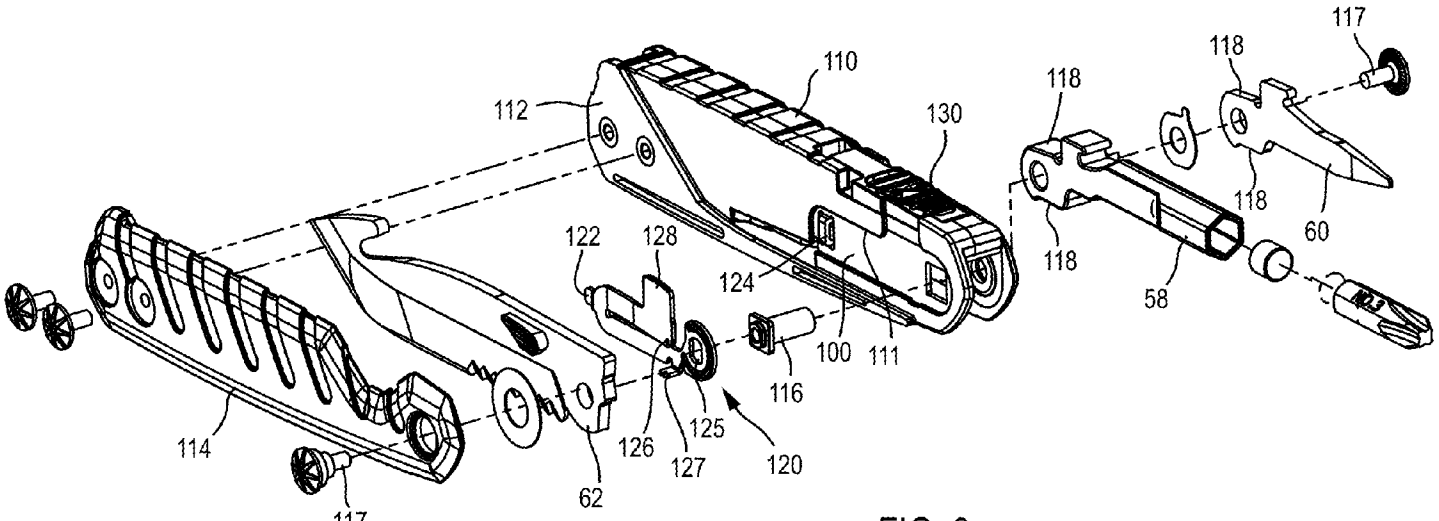
FIG. 9 is an exploded view of the removable handle of the multi-purpose tool of FIG. 1, in accordance with an exemplary embodiment.

Referring to FIG. 9, the frame (e.g., inner frame) 100 as shown in FIG. 8 fits within an outer frame 110 that forms the removable handle 54. The removable handle 54 includes various components including the bit driver 58, the small flat driver 60, and the knife 62 held together by various fasteners and other components. The bit driver 58 and the small flat driver 60 are configured to be received within the wide second end 106 of the inner frame 100 (as shown in FIG. 8). The knife blade 62 is configured to be rotationally coupled to an external side 112 of the outer frame 110. A cover 114 is configured to be coupled to the outer frame 110 to substantially cover the knife blade 62 when the knife blade 62 is in the closed position. Each of the various tools or components (bit driver 58, small flat driver 60, knife blade 62) are configured to be rotationally coupled to the inner frame 100 and outer frame 110 (for example, by an axle 116 and fasteners 117). The tools can be rotated from a closed position (e.g., stored position, retracted position, etc.) in which the tool is concealed within the removable handle 54 and an open position (e.g., use position, operational position, deployed position, etc.) in which the tool extends from the removable handle 54.

According to an exemplary embodiment, the bit driver 58 and small flat driver 60 are configured to be stored within a compartment or chamber formed by the wide second end 106 of the inner frame 100 (between the pair of arms 108). As such, the bit driver 58 and small flat driver 60 are stored within the outer frame 110 since the inner fame 100 is provided within the outer frame 110. Each of the bit driver 58 and small flat driver 60 are rotatably coupled to the wide second end 106 of the inner frame 100 and corresponding end of the outer frame 110 (e.g, with an axle 116 passing through apertures the bit driver 58 and small flat driver 60 and fasteners 117). Each driver 58 and 60 includes a flat or locking feature 118 for engagement with a locking button or slide 130 coupled to the removable handle 54.

According to an exemplary embodiment, the removable handle 54 includes a liner lock feature for the knife blade 62 (e.g., as shown in FIG. 9). For example, the liner lock feature includes a lock plate 120 having a tab 122 at a first end of the lock plate 120 that is configured to be inserted into an opening formed by a projection 124 of the inner frame 100 that extends through an opening 111 of the outer frame. The lock plate 120 also has an opening 125 at a second end of the lock plate configured for rotational attachment with an opening in a tang of the knife blade (e.g., via axle 116). The opening 125 at the second end of the lock plate is surrounded by a raised material feature that functions as a washer to aid in the rotational movement of the knife blade 62 with respect to the handle 56.

The lock plate 120 also includes a feature shown as a detent 126 that aids in biasing or keeping the knife blade 62 in the closed position once the knife blade 62 is in the closed position. According to an exemplary embodiment, the detent 126 is a bump or projection that interacts or engages with a corresponding recess in the tang of the knife blade 62 (or vice versa). The lock plate 120 also includes a stop tab 127 configured to restrict the rotational movement of the knife blade 62 as the blade 62 is moved to the open position. In other words, the knife blade 62 stops rotating once a portion of the tang of the knife blade 62 hits or contacts the stop tab 127.

The lock plate 120 also includes a locking tab 128 that angles out away from the main body of the lock plate 120 to lock the knife blade 62 in the open position. For example, the locking tab 128 engages with a portion of the tang of the knife blade once the knife is in the open position. In order to close the knife blade 62, a user must first press in on the locking tab 128 to disengage it from the tang of the knife blade 62. In this way, the knife blade 62 can be safely rigidly or fixedly secured in the open position for use by a user.

According to an exemplary embodiment, the fixed handle 56 of the communications tool 50 (as shown in FIGS. 5-7 and 11A-11B) is configured to house or store at least one bit for use with the bit driver of the removable handle 54. For example, as shown in FIGS. 5-7, five bits are stored within the fixed handle 56. However, according to other exemplary embodiments, fewer or greater bits may be stored within the removable handle 54.

Figure 10:
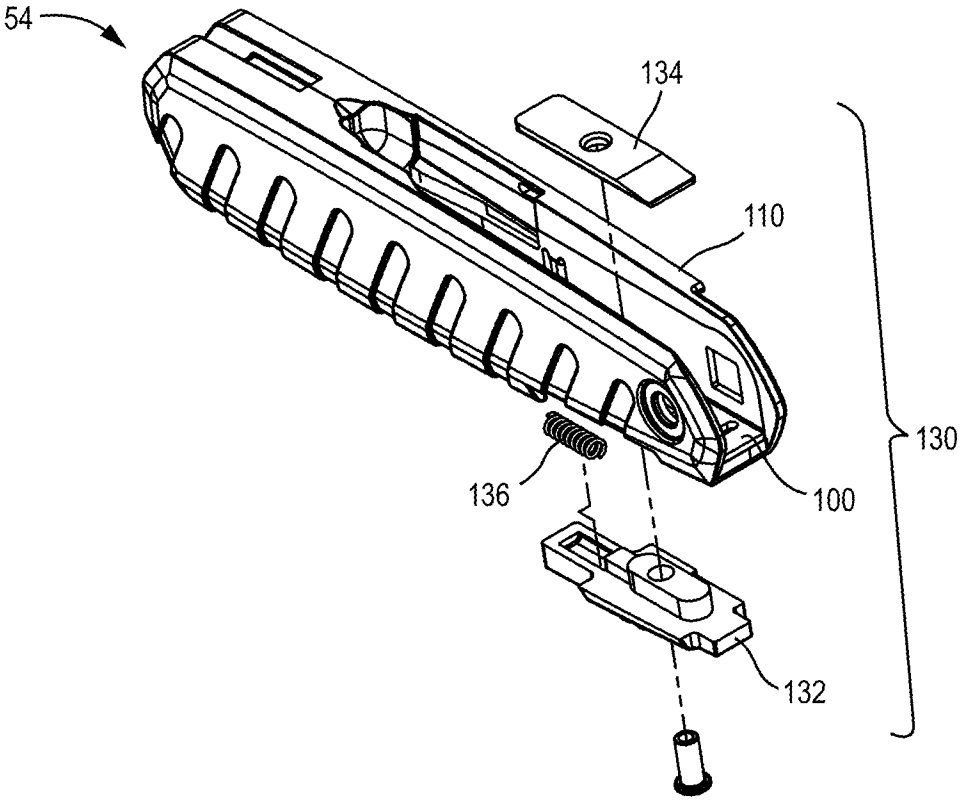
FIG. 10 is an exploded views of the locking slide of the removable handle of FIG. 9, in accordance with an exemplary embodiment.

According to an exemplary embodiment, as shown in FIGS. 7 and 10, the button or slide 130 may include a button wedge 132 and a corresponding wedge member 134. The slide 130 is accessible from outside of the removable handle 54 and slides from a first position (locked position) to a second position and is biased in the first position by a biasing member 136 (such as a coil spring). The bit driver 58 and small flat driver 60 may be locked into the operational position extending out of the outer frame 110 and in a stored position within the outer frame 110 when the slide 130 is in the locked position and the wedge member 134 engages a locking feature 118 on the bit driver 58 or the small flat driver 60, preventing the rotation of the bit driver 58 or the small flat driver 60 about the axle 116 (see FIG. 9). In the second position, the wedge member 134 is moved away from the bit driver 58 and the small flat driver 60, allowing rotation the bit driver 58 or the small flat driver 60 about the axle 116.

Figure 11B:
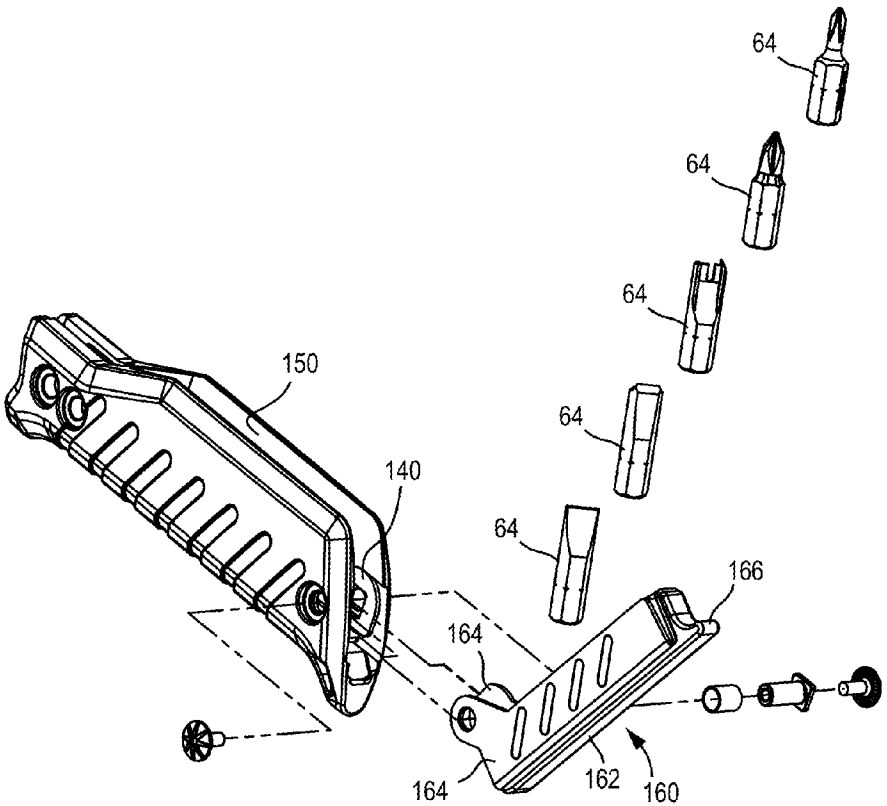
FIGS. 11A and 11B are exploded views of the fixed handle of the multi-purpose tool of FIG. 1, in accordance with an exemplary embodiment.
Figure 11A:
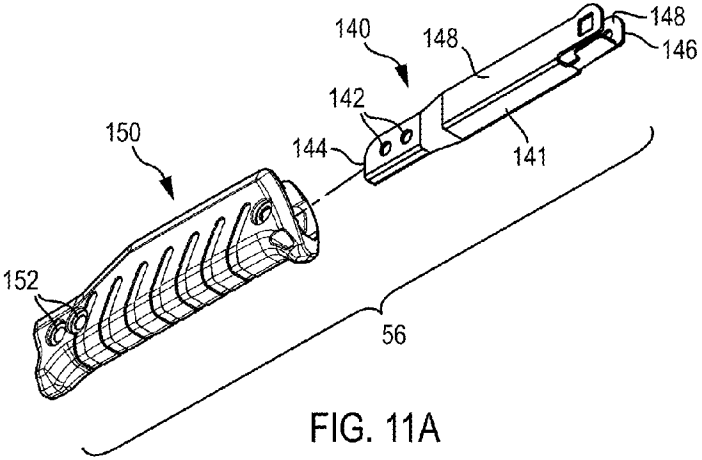

As shown best in FIG. 11A, the fixed handle 56 includes an outer cover 150 configured to receive a frame member 140. The frame member 140 may have a general appearance that is similar to the inner frame 100 of the removable handle 54. For example, the frame member 140 includes a body 141 having a pair of opposing arms 148 projecting out and away from the body 141 at substantially a right angle and a first narrow end 144 and a second wide end 146. The first end 144 of the frame 140 includes a pair of openings 142 that correspond to openings 152 in the cover 150 for coupling the fixed handle 56 to the tang 78 of the second jaw portion 72 (e.g., as shown in FIG. 4). The second wide end 146 of the frame 140 is configured for rotationally coupling with a holder or compartment 160 for receiving the various bits 64. For example, as shown in FIG. 11B, the holder 160 includes a main body portion 162 configured for receiving the various bits 64, a pair of arms 164 for rotationally coupling with the second wide end 146 of the frame 140, and a projection 166 generally opposite the pair of arms 164 for engagement by a user to move the holder 160 from a closed position to an open or operational position.

According to an exemplary embodiment, the various bits 64 are held within the holder 160 by a friction or interference fit. In some embodiments, the bits 64 and/or the holder 160 may be magnetized so that the bits 64 may be held within the holder 160 by a magnetic force. Additionally, as can be seen in FIGS. 5-7, the tips or ends of the various bits 64 extend outward from the holder 160 such that a user may grasp the bits 64 to extract them from the holder 160. The bits 64 are arranged at an angle with respect to the longitudinal axis of the holder 160 such that the bits 64 fit within the compartment or chamber formed by the fixed handle 56 in a closely arranged fashion. As such, the fixed handle 56 may be designed with a small profile such that the handle 56 fits ergonomically within a hand of a user.

As shown in FIGS. 5-7, only the projection 166 of the holder 160 is provided external the fixed handle 56. That is, only the projection 166 protrudes from the end of the fixed handle 56 so that a user may open the holder 160 when needed. According to an exemplary embodiment, the holder 160 of the fixed handle 56 may only be accessed after the removable handle 54 is first removed from the communications tool 50. As such, a user does not have to worry about losing the bits within the holder 160 by having the holder 160 inadvertently open during use of the communications tool 50.

As shown in FIGS. 1-3B and FIGS. 5-7, the fixed handle 56 is provided in a fixed state with respect to the jaw head 52 of the communications tool 50. In other words, the fixed handle 56 is designed to remain attached to the communications tool 50 even after the removable handle 54 is removed from the communications tool 50. However, according to another exemplary embodiment (not shown), the fixed handle 56 may be configured to be removed from the jaw head 52 of the communications tool 50. For example, the fixed handle 56 and the second jaw portion 72 may include features similar to the removable handle 54 and first jaw portion 70 of the communications tool 50 such that the fixed handle 56 can be easily removed from the second jaw portion 72 of the communications tool 50. For example, the fixed handle 56 and second jaw portion 72 may include a lock lever having a projection configured to engage with a cutout or notch of the fixed handle 56 similar to the design of the removable handle 54 as discussed above.

Referring now to FIGS. 12-25, a multi-purpose tool is shown according to another exemplary embodiment. As shown in this exemplary embodiment, the multi-purpose tool is an electrician's tool 250 for use by an electrician or field lineman. The electrician's tool 250 includes a jaw head 252 having at least one removable handle (e.g., two removable handles 254 and 256), where the removable handles 254 and 256 can be used as separate hand tools separate and apart from the electrician's tool 250. In addition, the jaw head 252 of electrician's tool 250 may be used as a separate tool that is separate and apart from the removable handles 254 and 256.

Figure 12:
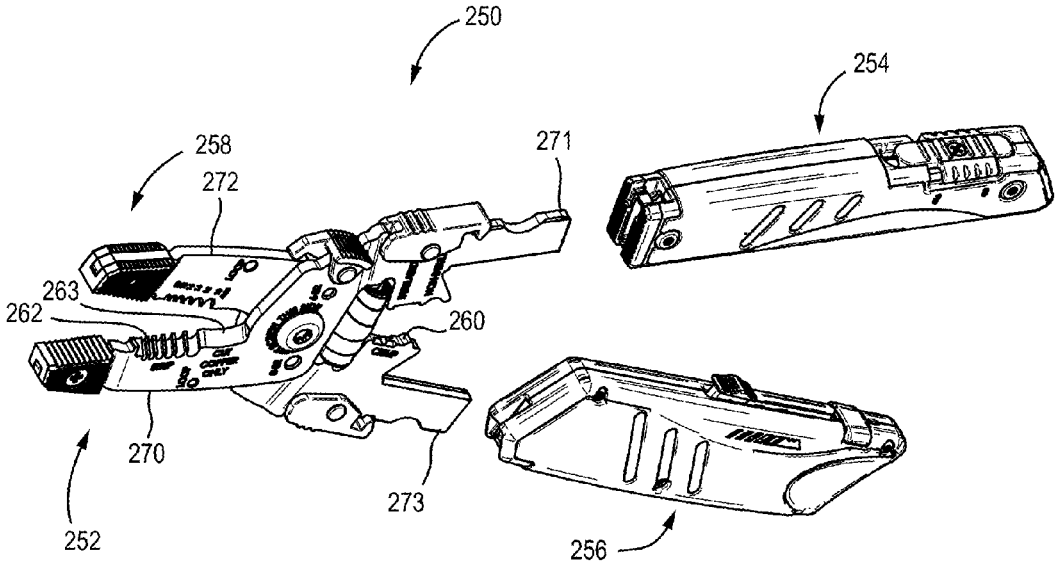
FIG. 12 is an exploded view of a multi-purpose tool, in accordance with another exemplary embodiment.

As shown in FIG. 12, according to an exemplary embodiment, the jaw head 252 includes a pliers feature, a hammering feature 258, a wire stripper 262, a wire cutter 263, and a terminal crimper 260. The jaw head 252 further includes a set of jaws (e.g., a first jaw portion 270 and a second jaw portion 272) having tangs 271 and 273 configured to receive a removable handle (e.g., a first removable handle 254 and second removable handle 256).

Figure 13:
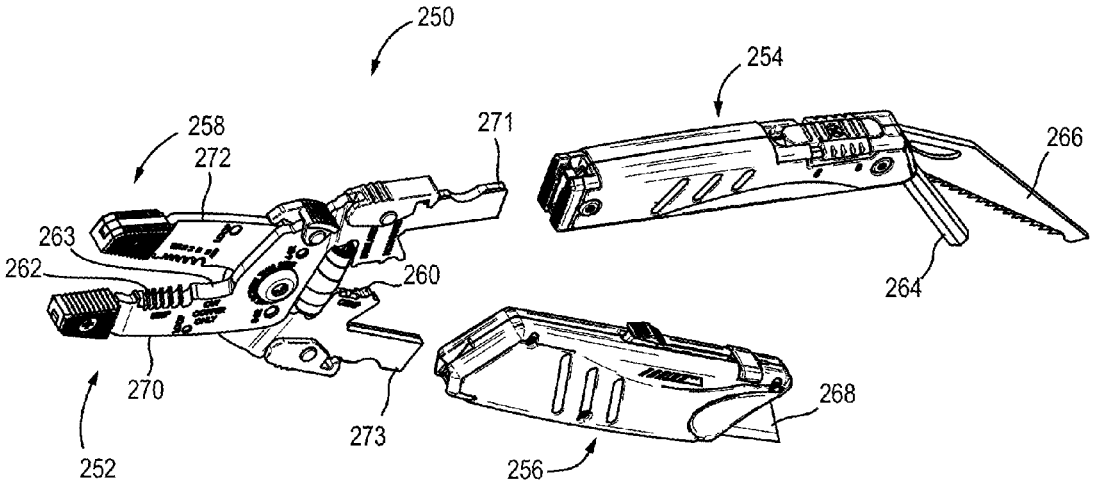
FIG. 13 is an exploded view of the multi-purpose tool of FIG. 12 showing various tools, in accordance with another exemplary embodiment.
Figure 14:
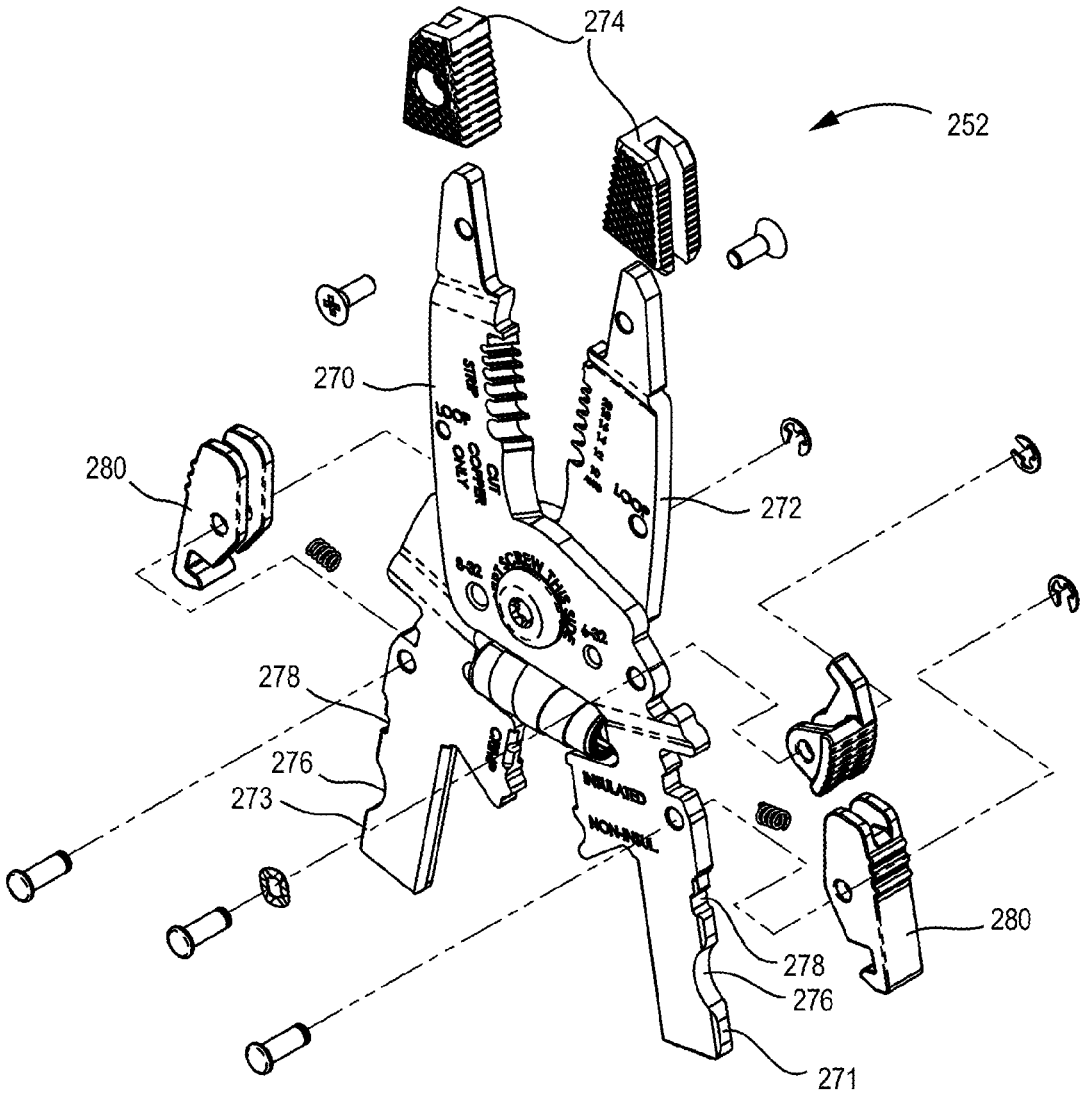
FIG. 14 is an exploded view of the jaw head of the multi-purpose tool of FIG. 12, in accordance with an exemplary embodiment.

As best shown in FIG. 13, the first removable handle 254 includes a bit driver 264 (e.g., for driving bits) and a knife blade or saw (e.g., a sheet rock saw 266). According to an exemplary embodiment, the second removable handle 256 may be used as a utility knife (e.g., having a removable utility blade 268).

According to an exemplary embodiment, the electrician's tool 250 may be used as a hammer. When used as a hammer, the electrician's tool 250 may include the removable handles 254 and 256 attached to the jaw head 252. According to another exemplary embodiment, the jaw head 252 may be used as a hammer with one or both of the handles removed. As shown best in FIG. 14, jaw tips 274 are configured to be coupled to the ends of the jaw head 252 and can be used as a hammering feature 258. According to another exemplary embodiment, the jaw tips 274 may also comprise a serrated or plier edge. When the jaw head 252 is used as a hammer separate from the removable handles 254 and 256 (e.g., the removable handles 254 and 256 have been removed from the jaw head 252), a user may grip the tang portions 271 and 273 of the jaw head 252. According to one exemplary embodiment, as shown in FIG. 12, the tang portions 271 and 273 include a groove or cutout 276 used as a finger groove such that a user may more easily hold or grasp the jaw head 252 (e.g., to use as a hammer).

The tangs 271 and 273 may have similar features to the tangs 76 and 78 of the jaw portions 70 and 72 of the communications tool 50 for locking and unlocking the removable handles 254 and 256 from the respective tang. According to an exemplary embodiment, the electrician's tool 250 includes a lever lock 280 pivotally attached to a portion of the tang 271 or 273 and configured to rotate from a first or locked position to a second or unlocked position to allow the handle 254 or 256 to be removed from the jaw head 252 of the electrician's tool 250. The lever lock 280 includes a projection 282 configured to engage with a notch 284 of a frame of each removable handle (as shown in FIGS. 15 and 16) as well as a notch 278 in the tangs 271 and 273.

The lever lock 280 and notches 278 and 284 are similar in structure and function to the lock lever 80 and notches 92 and 102 described above.

Figure 15:
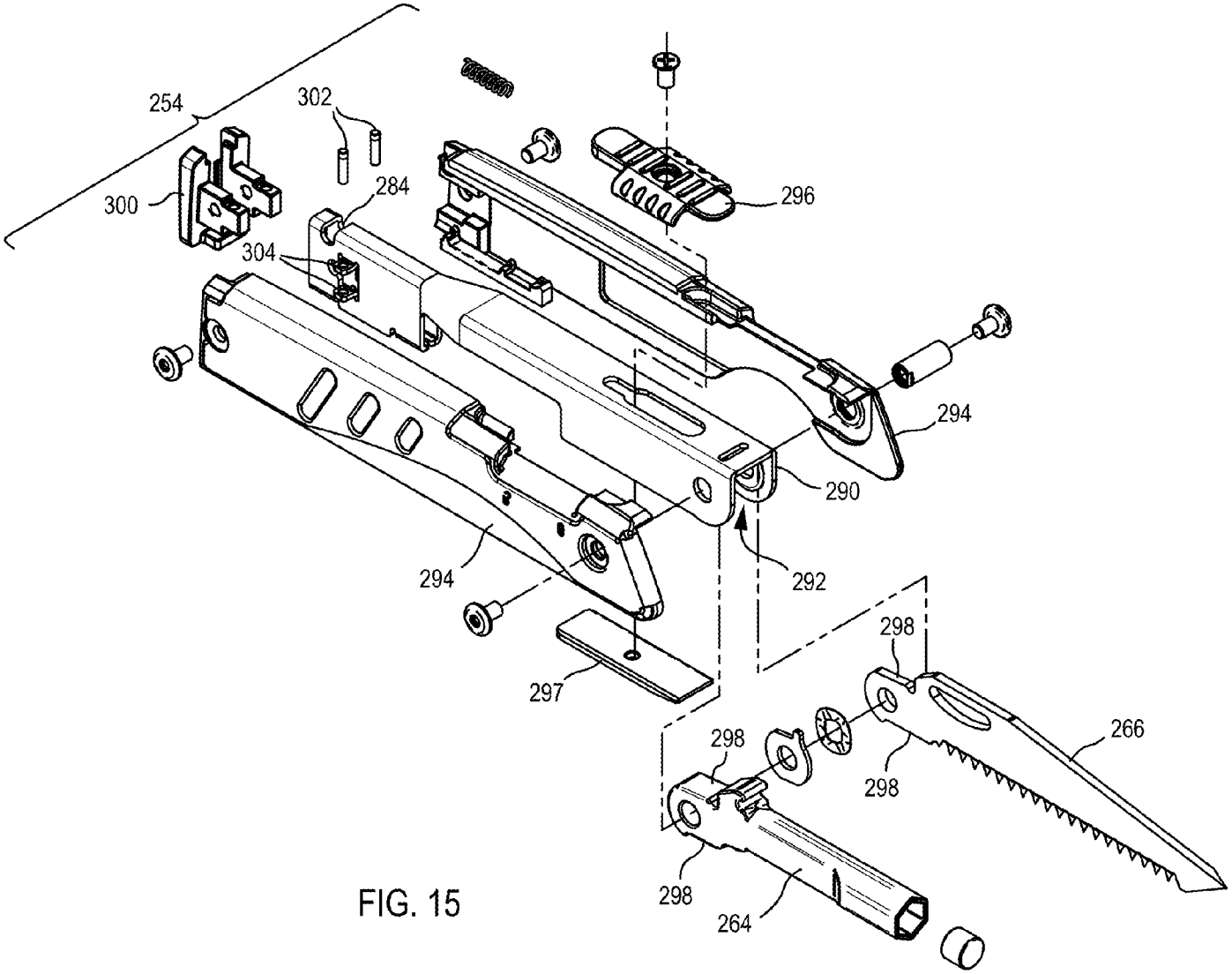
FIG. 15 is an exploded view of the first removable handle of the multi-purpose tool of FIG. 12, in accordance with an exemplary embodiment.
Figure 16:
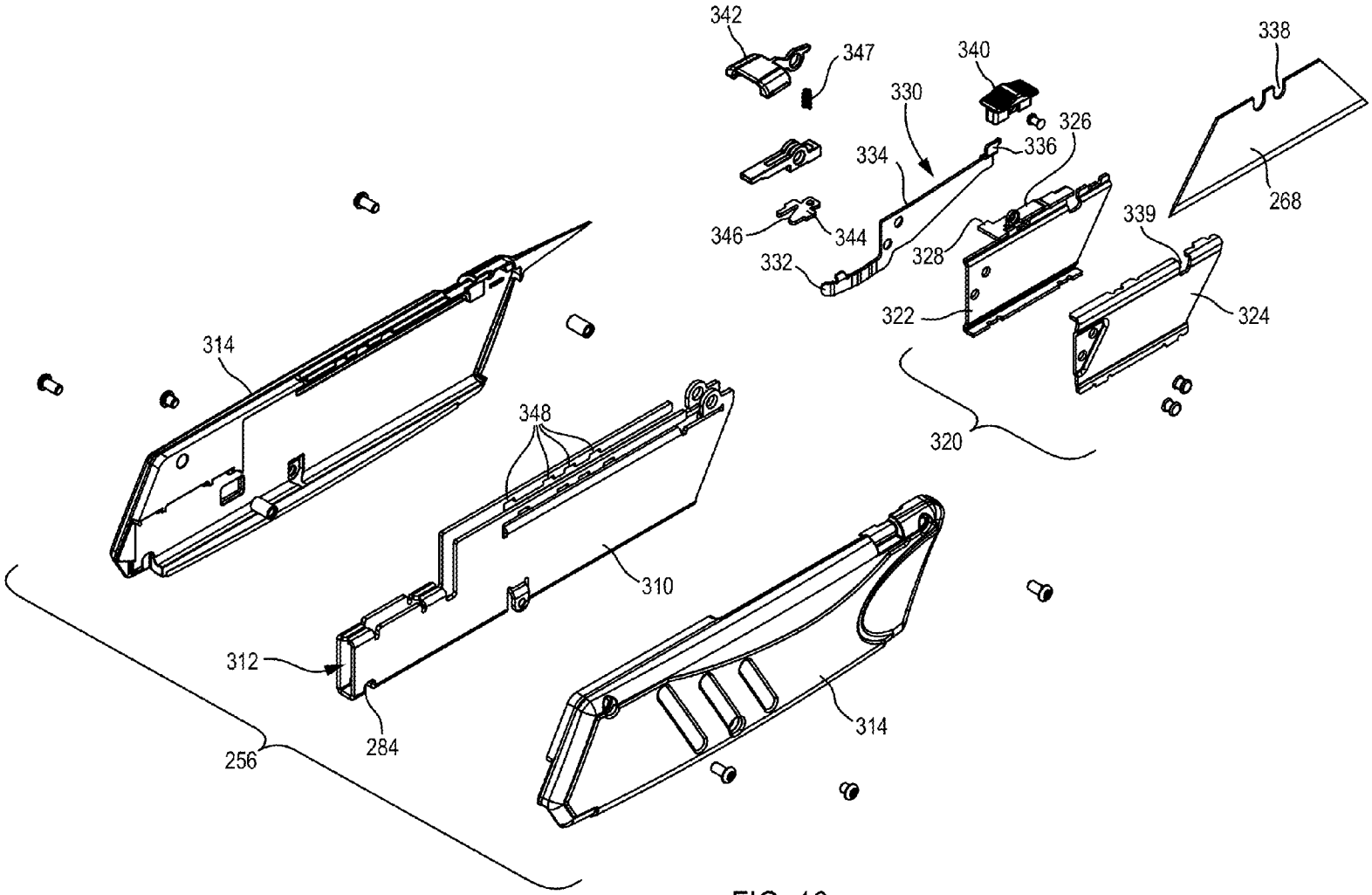
FIG. 16 is an exploded view of the second removable handle of the multi-purpose tool of FIG. 12, in accordance with an exemplary embodiment.
Figure 17:
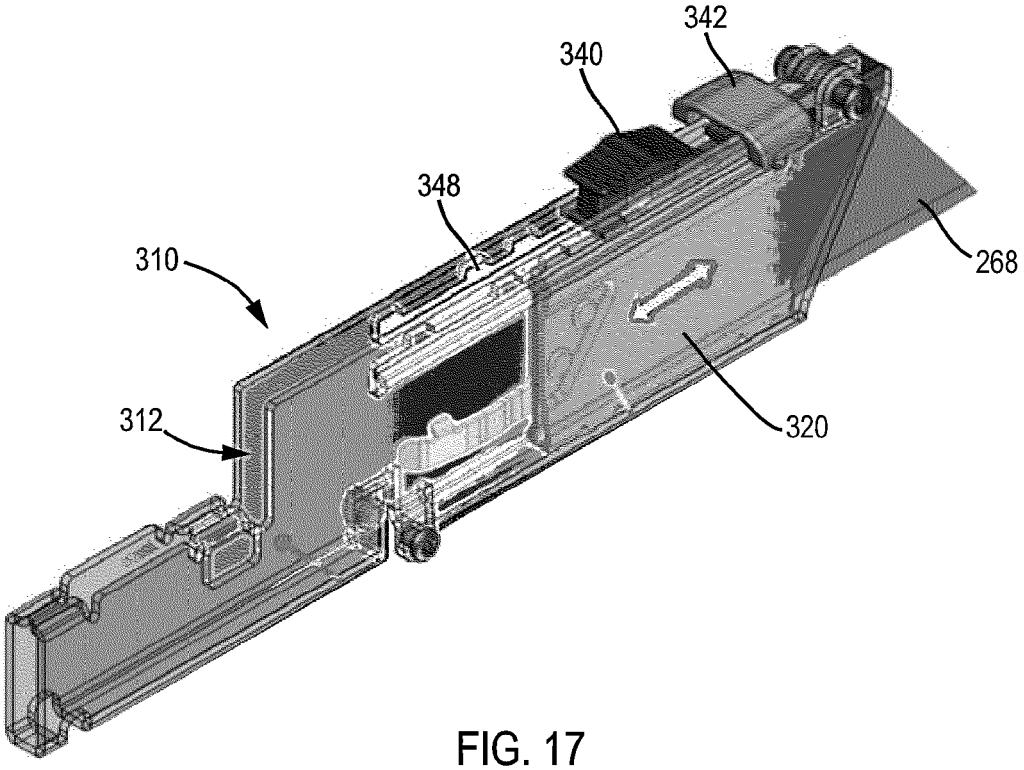
FIG. 17 is an isometric view of the blade carrier and the inner frame member of the second removable handle of FIG. 16.
Figure 18:
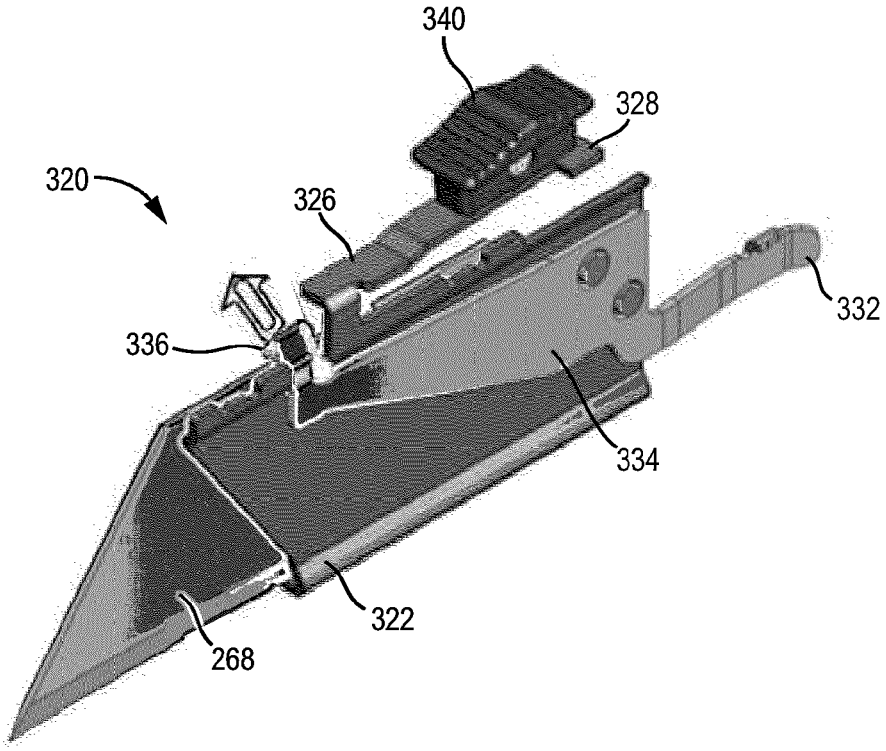
FIG. 18 is a rear isometric view of the blade carrier of FIG. 17 with the second blade carrier member removed.
Figure 19:
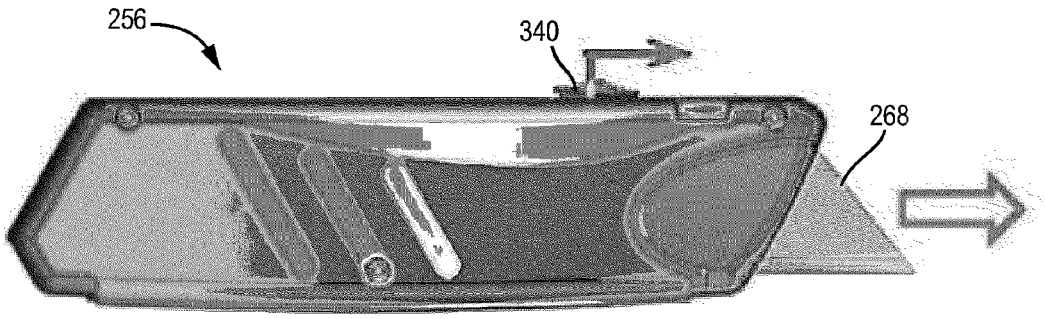
FIG. 19 is a front view of the second removable handle of FIG. 16 with the utility blade in a deployed position.
Figure 20A:
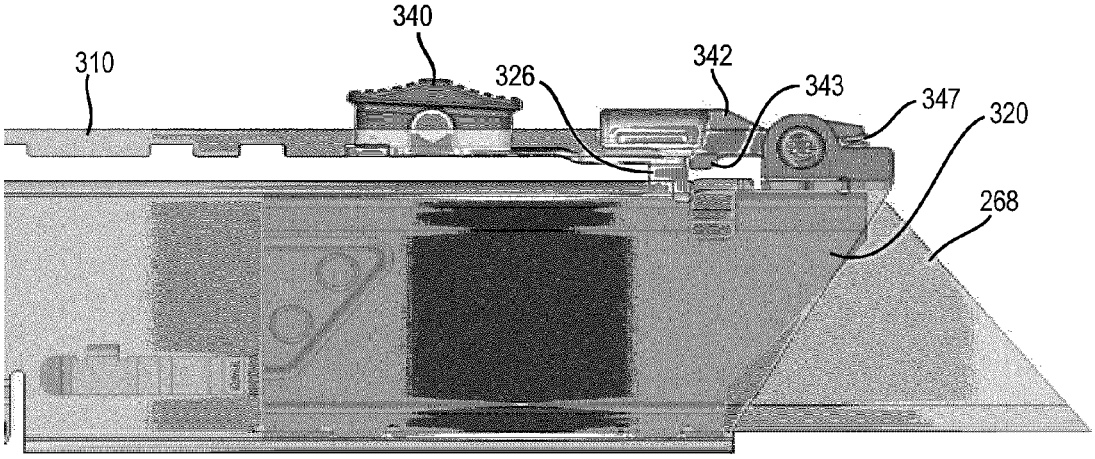
FIG. 20A is a front view of the inner frame and blade carrier of the second removable handle of FIG. 16 with the utility blade deployed and the safety latch in a closed position.
Figure 20B:
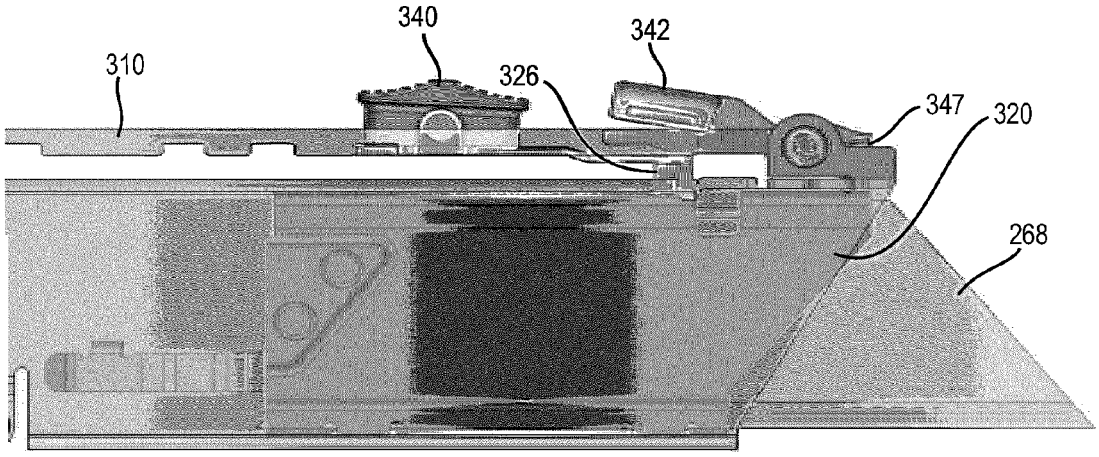
FIG. 20B is a front view of the inner frame and blade carrier of the second removable handle of FIG. 16 with the utility blade deployed and the safety latch in an open position.

Referring now to FIG. 15, an exploded view of the first removable handle 254 for the electrician's tool 250 is shown according to an exemplary embodiment. The first removable handle 254 is shown to include various implements or tools such as a knife or saw 266 and a driver 264. Each tool is configured to be rotationally coupled to an end of the handle 254 that is opposite the end of the handle 254 that is coupled to the electrician's tool 250. The tools are configured to be contained within a compartment or chamber 292 formed by an inner frame 290. The frame 290 is housed in an outer casing 294 (e.g., housing, cover, handle halves, etc.). When not in use, the tools are located within the handle 254. To use a tool, the user rotates the tool out of the chamber 292 so that it extends out from the end of the handle 254.

According to one exemplary embodiment, a locking feature may be included with the handle 254. The locking system may bias the tools in a closed state when the tools are folded within the handle 254. For example, the locking system may exert a biasing pressure on a portion of the tang of the tools. Additionally, the locking system may lock the tools in an operational or in-use position. As shown in FIG. 15, the locking system includes a locking button 296 that is slidably coupled to the outer casing 294. Each of the driver 264 and the saw 266 includes a feature shown as a locking feature 298 for engagement with the locking button or slide 296. For example, a portion of a wedge 297 that is coupled to the locking button 296 may be configured to interact with the locking feature 298 on a portion of the tang of the driver 264 and the saw 266. A user slides or engages the locking button 296 from a first position to a second position in order to unlock the tools before folding them back within the handle 254.

According to one exemplary embodiment, the first removable handle 254 also includes a feature configured to allow the first removable handle 254 to be struck with a hammer or other implement (e.g., the hammering feature 258 of the jaw head 252). According to one exemplary embodiment, the feature is a handle pommel 300 (e.g., an investment casting) that is coupled to the frame 290 of the first removable handle 254. The handle pommel 300 is configured to be coupled to an end of the first removable handle 254 such that when a hammer or the implement strikes the pommel 300, the force is transmitted through the first removable handle 254 into an implement or tool of the first removable handle 254 (e.g., the bit driver 264 or the saw 266). As shown in FIG. 15, the pommel 300 is coupled to the outer casing 294 of the frame via a retainer pin 302 that fits within openings of tabs 304 that extend out from the frame 290. As such, when a user strikes the pommel 300, the pommel 300 exerts a force on the pins 302 and the tabs 304 of the frame 290 and not the end portion of the frame 290 that is received on the tang 271 of the first jaw portion 270 of the electrician's tool 250. Thus, even if the pommel 300 is slightly deformed and/or the pommel connection to the frame 290 is slightly deformed, the removable handle 254 will still be able to fit back onto the tang 271 of the first jaw portion 270 of the electrician's tool 250.

Referring now to FIG. 16, an exploded view of the second removable handle 256 of the electrician's tool 250 is shown according to an exemplary embodiment. The second removable handle 256 includes an inner frame 310 configured to fit within an outer casing 314 (e.g., housing, cover, handle halves, etc.) that form the second removable handle 256. The inner frame has a generally U-shaped cross-sectional shape and a first end of the frame 310 includes a notch or cutout 284 for coupling with the lever lock 280 of the jaw head 252 of the electrician's tool 250. The frame 310 includes a channel 312 formed by the first end of the frame 310 into which a portion of the tang 273 of the jaw head 252 may be slid. As discussed above, the channel 312 is sized appropriately to fit tightly (e.g., closely, securely, snuggly, etc.) with the tang portion 273 of the jaw head 252.

The frame 310 of the second removable handle 256 is also configured to receive a blade carrier 320. The blade carrier 320 is configured to selectively receive a blade such as the utility blade 268 shown in FIGS. 16-18. The blade carrier 320 may include a first member 322 and a second member 324 coupled to the first member 322 to define an opening or chamber configured to receive a portion of the utility blade 268. The blade carrier 320 is configured to be selectively slid within the frame 310 of the second removable handle 256 to expose a portion of the utility blade 268 (e.g., for cutting with the utility blade).

A member shown as a latch arm 330 is configured to be coupled to an outer portion of the first member 322 of the blade carrier 320. The second removable handle 256 also includes a slide button 340 coupled to the blade carrier 320, a safety latch 342 coupled to the inner frame 310, and a latch plate 344.

The latch arm 330 includes a biasing member 332 that extends from an end of the body portion 334 of the latch arm 330. The biasing member 332 is configured to bias the blade carrier 320 within the frame 310 against one side of the frame 310. The latch arm 330 also includes a member shown as a projection or tab 336 configured to engage with a slot or notch 338 in the utility blade 268 and an aligned notch 339 in the blade carrier 330. When the tab 336 of the latch arm 330 is engaged with the utility blade 268, the utility blade 268 is substantially secured within the blade carrier 330. According to another exemplary embodiment, the tab 336 of the latch arm 330 is spring loaded into the locked position via the biasing member 332 of the latch arm.

According to another exemplary embodiment, the slide button 340 is biased into a locked position along several detents 348 that are provided within the frame 310 of the removable handle 256. As such, the utility blade 268 may be selectively locked or temporarily provided within a predetermined position as the slide button 340 is received within any one of these detents 348. According to an exemplary embodiment, the blade carrier includes a locking member 326 having tabs 328 that interact with the detents 348 such that a slide button 340 must be pushed down in order to unlock the tabs 328 of the locking member 326 from the detents 348 of the frame 310.

Referring now to FIGS. 19-25, a method of removing and/or replacing the utility blade 268 from the second removable handle 256 is shown according to an exemplary embodiment. In order for a user to remove the utility blade 268 (e.g., for replacing the utility blade 268), a user pushes down on the slide button 340 and slides the slide button 340 forward towards the end of the handle 256. The forward movement of the slide button 340 moves the utility blade 268 forward. The forward movement of the slide button 340 is stopped by the contact between the locking member 326 on the blade carrier 320 and a projection 343 of the safety latch 342 (as shown in FIG. 20A). The position in which the locking member 326 contacts the projection 343 is the most forward operational position that a user can use the utility blade with the second removable handle 256. At this forward operational position, a user can then lift the safety latch 342 from its closed position to the open position (as shown in FIG. 20B). According to one exemplary embodiment, the safety latch 342 may be biased into a closed or locked position by a biasing member 347 (e.g., a coil spring) (see FIG. 16).

Figure 21:
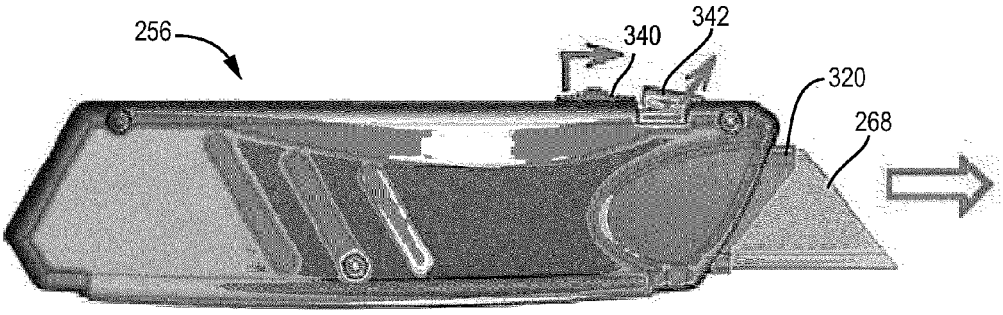
FIG. 21 is a front view of the second removable handle of FIG. 16 with the utility blade in a blade release position.
Figure 22:
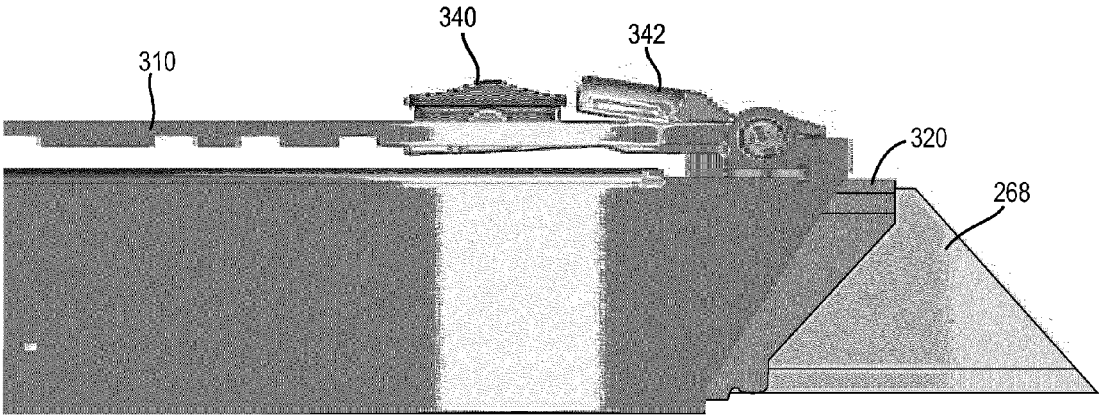
FIG. 22 is a front view of the inner frame and blade carrier of the second removable handle of FIG. 16 with the utility blade in a blade release position.
Figure 23:
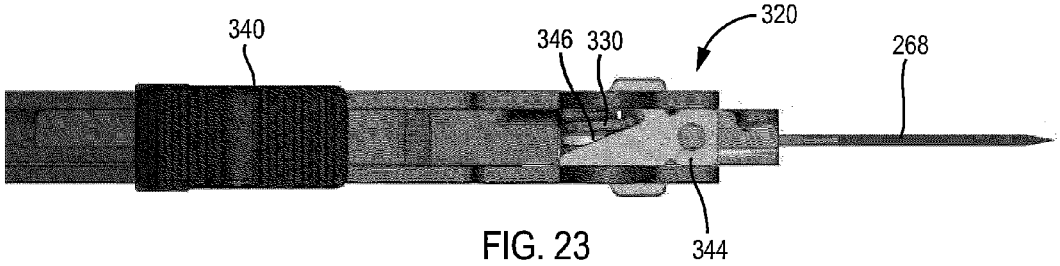
FIG. 23 is a top view of the blade carrier of the second removable handle of FIG. 16 in a blade release position.
Figure 24:
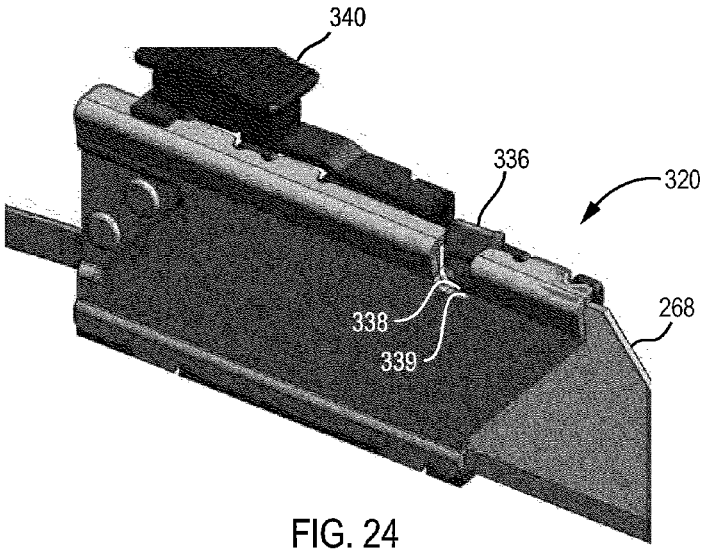
FIG. 24 is an isometric view of the blade carrier of the second removable handle of FIG. 16 in a blade release position.
Figure 25:
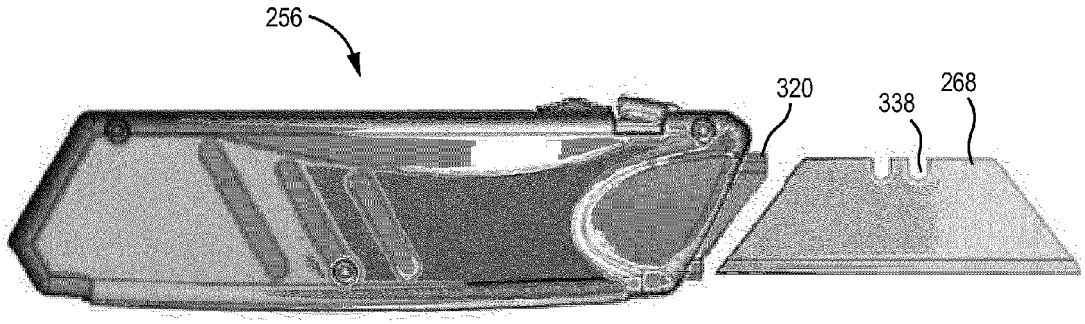
FIG. 25 is a front view of the second removable handle of FIG. 16 with the utility blade removed.

Lifting the safety latch 342 moves the projection 343 of the safety latch 342 out of the path of the blade carrier 320, allowing further forward movement of the blade carrier 320 (e.g., by continuing to move the slide button 340 forward as shown in FIGS. 21 and 22). As this is done, the tab 336 of the latch arm 330 is automatically moved away or disengaged from the notch 338 in the blade 268 by engaging an angled surface 346 on the latch plate 344, which is coupled to the frame 310 (as shown in FIGS. 23-24). Thus, as the user moves the slide button 340 and the blade carrier 320 forward into the blade release position, the blade 268 is automatically disengaged from the blade carrier 320 so that a user may now remove the utility blade 268 from the blade carrier 320 (as shown in FIG. 25).

A user may then install a new blade into the blade carrier 320 or reverse the utility blade 268 within the blade carrier 320 so that the unused portion of the utility blade 268 is now exposed. A user then simply slides the slide button 340 backwards to draw the utility blade 268 back into the handle 256. As the blade 268 (and the blade carrier 320) are retracted back into the channel 312 in the frame 310, the tab 336 of the latch arm 330 disengages the angled surface 346 of the latch plate 344, automatically locking the blade 268 to the blade carrier 320. The safety latch 342 can then be moved to its closed position, and the second removable handle 256 can be used again as a utility knife. One advantage of this design is that it allows for single hand removal of the utility blade 268. A user can grip the second removable handle 256 and operate the slide button 340 forward, lift the safety latch 342, and then continue to push the slide button 340 forward to automatically disengage the utility blade 268, all with a single hand.

While the detailed drawings and specific examples given describe various exemplary embodiments of the multi-purpose tool, they serve the purpose of illustration only. It is to be understood that the invention is not limited in its application to the details of construction and the arrangements of components set forth in the preceding description or illustrated in the drawings. Furthermore, other substitutions, modifications, changes, and omissions may be made in the design, operating conditions, and arrangements of the exemplary embodiments without departing from the scope of the invention.

What is claimed is:

1. A multi-purpose tool, comprising:

a jaw head;

a first handle removably coupled to the jaw head, the first handle comprising a first body and a hand tool pivotably coupled to the first body, the hand tool moveable between a closed position in which the hand tool is disposed within the first body and an open position in which the hand tool extends out of the first body, wherein the hand tool comprises a bit driver; and a second handle coupled to the jaw head, wherein the second handle comprises a second body, a plurality of bits configured for use with the bit driver, and a holder pivotably coupled to the second body, the holder configured to store the plurality of bits, and the holder moveable between a closed position in which the holder is disposed within the second body and an open position in which the holder extends out of the second body to allow the bits to be removed from the holder;

wherein the first handle can be removed from the jaw head to be utilized separately from the jaw head; and wherein the holder of the second handle is only accessed after the first handle has been removed from the jaw head.

2. The multi-purpose tool of claim 1, wherein the bits comprise screw driver bits or punch down bits.

3. The multi-purpose tool of claim 1, wherein the first handle further comprises a second hand tool pivotably coupled to the first body.

4. The multi-purpose tool of claim 3, wherein the second hand tool comprises a sheet rock saw, a screwdriver or a knife blade.

5. The multi-purpose tool of claim 1, wherein the jaw head comprises one of a cable crimper, a cable stripper, a wire cutter, a wire stripper, pliers, or a terminal crimper.

6. The multi-purpose tool of claim 1, further comprising:

a locking mechanism movable between a locked position and an unlocked position, the locking mechanism comprising a lock body and a projection extending away from the lock body;

wherein the jaw head comprises a first jaw pivotably coupled to a second jab, the first jaw comprising a first tang and the second jaw comprising a second tang; and further comprising:

wherein the locking mechanism is coupled to the jaw head;

wherein the first handle is removably coupled to the first tang;

wherein the first tang comprises a notch and the first handle comprises a notch configured to align with the notch in the first tang when the first handle is in an installed position relative to the first tang, the aligned notches configured to receive the locking mechanism in the locked position to prevent the removal of the handle from the first tang;

wherein the first handle is fixed to the jaw head when the locking mechanism is in the locked position due to the projection of the locking mechanism contacting both the first tang and the first handle, and the first handle is able to be removed from the first tang when the locking mechanism is in the unlocked position.

7. The multi-purpose tool of claim 6, wherein the first handle comprises an opening that is configured to slidably engage the first tang.

8. The multi-purpose tool of claim 6, further comprising a biasing member configured to bias the locking mechanism into the locked position.

9. A multi-purpose tool, comprising:

a jaw head comprising a first jaw pivotably coupled to a second jaw, the first jaw comprising a first tang and the second jaw comprising a second tang, wherein the two jaws comprise a wire stripper and an additional tool;

a locking mechanism pivotably attached to the jaw head, the locking mechanism movable between a locked position and an unlocked position, the locking mechanism comprising a lock body and a projection extending away from a first end of the lock body; and a first handle removably coupled to the first tang;

a second handle removably coupled to the second tang;

wherein the first handle is independent from the second handle;

wherein the first tang comprises a notch and the first handle comprises a notch configured to align with the notch in the first tang when the first handle is in an installed position relative to the first tang, the aligned notches configured to receive the projection of the locking mechanism when the locking mechanism is in the locked position to prevent the removal of the first handle from the first tang;

wherein the first handle is fixed to the jaw head when the locking mechanism is in the locked position due to the projection of the locking mechanism contacting both of the aligned notches, and the first handle is able to be removed from the first tang when the locking mechanism is in the unlocked position.

10. The multi-purpose tool of claim 9, wherein the first handle comprises an opening that is configured to slidably engage the first tang.

11. The multi-purpose tool of claim 9, further comprising a biasing member configured to bias the locking mechanism into the locked position.

12. The multi-purpose tool of claim 9, wherein the second handle comprises a utility knife.

13. The multi-purpose tool of claim 9, wherein the first handle comprises a first body and a hand tool pivotably coupled to the first body, the hand tool moveable between a closed position in which the hand tool is disposed within the first body and an open position in which the hand tool extends out of the first body, and wherein the first handle can be removed from the jaw head to be utilized separately from the jaw head.

14. The multi-purpose tool of claim 13, wherein the hand tool comprises a bit driver;

wherein the second handle comprises a second body, a plurality of bits configured for use with the bit driver, and a holder pivotably coupled to the second body, the holder configured to store the plurality of bits, and the holder moveable between a closed position in which the holder is disposed within the second body and an open position in which the holder extends out of the second body to allow the bits to be removed from the holder; and wherein the holder of the second handle is only accessed after the first handle has been removed from the jaw head.

15. The multi-purpose tool of claim 9, wherein the additional tool comprises at least one of a crimper and a wire cutter.

16. The multi-purpose tool of claim 9, wherein the additional tool comprises a hammer.

17. The multi-purpose tool of claim 9, wherein the additional tool comprises a pliers.

18. The multi-purpose tool of claim 9, wherein the projection of the locking mechanism extends from the lock body to the first tang through the first handle.

19. The multi-purpose tool of claim 9, wherein the first handle includes a channel into which the first tang is removably inserted.

20. The multi-purpose tool of claim 19, wherein the channel is formed by a pair of opposing arms spaced apart a distance corresponding to a width of the first tang.

* * * * *